US007256545B2

(12) United States Patent
Woo et al.

(10) Patent No.: US 7,256,545 B2
(45) Date of Patent: Aug. 14, 2007

(54) PLASMA DISPLAY PANEL (PDP)

(75) Inventors: Seok-Gyun Woo, Suwon-si (KR); Chong-Gi Hong, Suwon-si (KR); Su-Bin Song, Suwon-si (KR); Kyoung-Doo Kang, Suwon-si (KR); Jun-Yong Park, Suwon-si (KR); Won-Ju Yi, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 238 days.

(21) Appl. No.: 11/089,153

(22) Filed: Mar. 25, 2005

(65) Prior Publication Data

US 2005/0225242 A1 Oct. 13, 2005

(30) Foreign Application Priority Data

Apr. 13, 2004 (KR) ..... 10-2004-0025285
May 21, 2004 (KR) ..... 10-2004-0036391

(51) Int. Cl.
*H01J 17/49* (2006.01)

(52) U.S. Cl. ..... 313/582; 313/586

(58) Field of Classification Search ..... 313/582, 313/586, 587

See application file for complete search history.

(56) References Cited

U.S. PATENT DOCUMENTS 5,004,950 A * 4/1991 Lee ..... 313/582
5,371,437 A * 12/1994 Amano ..... 315/169.1
5,541,618 A 7/1996 Shinoda
5,661,500 A 8/1997 Shinoda et al.
5,663,741 A 9/1997 Kanazawa (Continued)

FOREIGN PATENT DOCUMENTS

JP 02-148645 6/1990

(Continued)

OTHER PUBLICATIONS

"*Final Draft International Standard*", Project No. 47C/61988-1/Ed.1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Nimeshkumar D. Patel
*Assistant Examiner*—Anthony Perry
(74) *Attorney, Agent, or Firm*—Robert E. Bushnell, Esq.

(57) ABSTRACT

A Plasma Display Panel (PDP) includes: a front panel; a rear panel parallel to and separated from a front panel; a plurality of first barrier ribs of a dielectric, arranged between the front panel and the rear panel, and adapted to define discharge cells together with the front panel and the rear panel; front discharge electrodes and rear discharge electrodes disposed apart to surround each discharge cell within the first barrier ribs, each of the front discharge electrodes and rear discharge electrodes including main line parts and corner parts adapted to connect the adjacent main line parts, wherein inner surfaces of the corner parts facing each discharge cell, are rounded; a phosphor layer arranged in each discharge cell defined by the first barrier ribs; and a discharge gas filling each discharge cell.

25 Claims, 18 Drawing Sheets

U.S. PATENT DOCUMENTS

| | | | | |
|---|---|---|---|---|
| 5,674,553 | A | 10/1997 | Sinoda et al. | |
| 5,724,054 | A | 3/1998 | Shinoda | |
| 5,744,909 | A * | 4/1998 | Amano | 313/585 |
| 5,786,794 | A | 7/1998 | Kishi et al. | |
| 5,952,782 | A | 9/1999 | Nanto | |
| RE37,444 | E | 11/2001 | Kanazawa | |
| 6,630,916 | B1 | 10/2003 | Shinoda | |
| 6,707,436 | B2 | 3/2004 | Setoguchi et al. | |
| 6,753,645 | B2 | 6/2004 | Haruki et al. | |
| 6,960,880 | B2 * | 11/2005 | Chien et al. | 313/582 |

FOREIGN PATENT DOCUMENTS

| | | |
|---|---|---|
| JP | 2845183 | 10/1998 |
| JP | 2917279 | 4/1999 |
| JP | 2001-043804 | 2/2001 |
| JP | 2001-325888 | 11/2001 |

* cited by examiner

PLASMA DISPLAY PANEL (PDP)

CLAIM OF PRIORITY

This application makes reference to, incorporates the same herein, and claims all benefits accruing under 35 U.S.C. §119 from applications entitled PLASMA DISPLAY PANEL earlier filed in the Korean Intellectual Property Office on 13 Apr. 2004 and 21 May 2004, and there duly assigned Ser. Nos. 10-2004-0025285 and 10-2004-0036391, respectively.

BACKGROUND OF THE INVENTION

1. Field of the Invention

The present invention relates to a Plasma Display Panel (PDP), and more particularly, to a flat PDP in which an image is displayed using light generated by ultraviolet rays generated in a discharge space by supplying a predetermined voltage to opposing electrodes arranged between opposing substrates when a discharge gas fills a space formed between the opposing substrates.

2. Description of the Related Art

PDP flat display devices show promise as next generation display devices due to their high image quality, compact dimensions, light weight, wide viewing angle, and relatively simple manufacturing process even for large screen sizes.

Current types of PDPs include Alternating Current (AC) PDPs, Direct Current (DC) PDPs, and hybrid PDPs. AC PDPs and DC PDPs can be either face discharge PDPs or surface discharge PDPs according to their structure.

DC PDPs have a structure in-which all of the electrodes are exposed in a discharge space, and charges directly migrate between corresponding electrodes. AC PDPs have a structure in which at least one electrode is covered by a dielectric layer, and charges do not move directly between the corresponding electrodes but rather a discharge is generated by wall charges.

Recently, AC PDPs, especially those having a three-electrode surface discharge structure, have been used to avoid the problem of electrode damage in DC PDPs due to the direct migration of charges between electrodes.

In an AC three-electrode surface discharge PDP, such as that discussed in U.S. Pat. No. 6,753,645, an AC three-electrode surface discharge PDP includes a front panel and rear panel.

The rear panel includes address electrodes that generate an address discharge, a rear dielectric layer that covers the address electrodes, a plurality of barrier ribs that define discharge cells, a phosphor layer coated onto both the side walls of the barrier ribs and the rear panel between the barrier ribs.

The front panel, facing the rear panel, includes X and Y electrodes that generate a sustain discharge, a front dielectric layer that covers the X and Y electrodes, and a protective layer. The X electrode can include a transparent X electrode, and a bus X electrode on one side of the transparent X electrode to avoid a voltage loss in the transparent X electrode. The Y electrode can include a corresponding transparent Y electrode and bus Y electrode.

However, in the PDP, visible light is generated in the discharge space and must pass through the transparent X electrode, the bus X electrode, the transparent Y electrode, the bus Y electrode, the front dielectric layer, and the protective layer, formed on the front panel. This reduces the transmittance of the visible light to approximately 60%.

Also, in the surface discharge PDP, electrodes that generate discharge are formed on the upper surface of the discharge space, that is, the inner surface of the front panel. For this reason, the discharge begins at the inner surface of the front panel and diffuses into the discharge space, thereby reducing the light emission efficiency.

Furthermore, in the surface discharge PDP, permanent latent images can form due to the sputtering of charged ions of the discharge gas by the electric field to the phosphor layer after long hours of operation.

SUMMARY OF THE INVENTION

The present invention provides a PDP that generates a uniform discharge in the entire discharge region, has an improved an aperture ratio and transmittance, and has an increased discharge region due to increased discharge surfaces.

The present invention also provides a PDP structure that effectively uses space charges of plasma, has an improved light emission efficiency, reduced generation of permanent latent images, and prevents the formation of edge-curls.

The present invention also provides a PDP structure that has a wide voltage margin by keeping discharge driving voltages virtually identical in each of the discharge cells that include phosphor layers having different dielectric constants.

According to an aspect of the present invention, a Plasma Display Panel (PDP) is provided comprising: a front panel; a rear panel parallel to and separated from the front panel; a plurality of first barrier ribs of a dielectric, arranged between the front panel and the rear panel, and adapted to define discharge cells together with the front panel and the rear panel; front discharge electrodes and rear discharge electrodes disposed apart to surround each discharge cell within the first barrier ribs, each of the front discharge electrodes and rear discharge electrodes including main line parts and corner parts adapted to connect the adjacent main line parts, wherein inner surfaces of the corner parts facing each discharge cell, are rounded; a phosphor layer arranged in each discharge cell defined by the first barrier ribs; and a discharge gas filling each discharge cell.

The inner surfaces of the corner parts are preferably rounded with a radius of at least 5% of the width of a surface having a lesser width of the main line parts adjacent to the inner corner.

An outer surface of at least one corner part is preferably rounded

The outer corner of the at least one corner part is preferably rounded with the same radius curvature of the inner surface of the corner part.

The PDP preferably further comprises a plurality of second barrier ribs adapted to define the discharge cells together with the plurality of first barrier ribs, the plurality of second barrier ribs preferably being arranged between the plurality of first barrier ribs and the rear panel and the phosphor layer being preferably arranged at least on a side surface of the plurality of second barrier ribs.

The front discharge electrodes and the rear discharge electrodes preferably extend in one direction and the PDP preferably further comprises address electrodes extending to cross the front discharge electrodes and the rear discharge electrodes.

The address electrodes are preferably arranged between the rear panel and the phosphor layer, and a dielectric layer is preferably arranged between the phosphor layer and the address electrodes.

The front discharge electrodes preferably extend in one direction, and the rear discharge electrodes preferably extend to cross the front discharge electrodes.

According to another aspect of the present invention, a Plasma Display Panel (PDP) is provided comprising: a front panel; a rear panel parallel to and separated from the front panel; a plurality of first barrier ribs of a dielectric, arranged between the front panel and the rear panel and adapted to define discharge cells together with the front panel and the rear panel by including a plurality of surfaces that surround sides of each discharge cell and meet at an obtuse angle; a plurality of front discharge electrodes and rear discharge electrodes arranged within the plurality of first barrier ribs and adapted to surround each discharge cell; a phosphor layer adapted to emit visible light in response to receiving ultraviolet rays, the phosphor layer being arranged within each discharge cell; and a discharge gas filling each discharge cell.

A protective layer having a plurality of surfaces that meet at an obtuse angle covers at least some of the plurality of first barrier ribs.

The PDP preferably further comprises a second plurality of barrier ribs adapted to define the discharge cells together with the first plurality of barrier ribs, the second plurality of barrier ribs being arranged between the first plurality of barrier ribs and the rear panel, and the second plurality of barrier ribs preferably including a plurality of surfaces adapted to surround the sides of each discharge cell and meet at an obtuse angle.

The front discharge electrodes and the rear discharge electrodes preferably include a plurality of surfaces adapted to surround the sides of each discharge cell and meet at an obtuse angle.

The front discharge electrodes and the rear discharge electrodes preferably extend in one direction, and the PDP preferably further comprises address electrodes extending to cross the front discharge electrodes and the rear discharge electrodes.

The address electrodes are preferably arranged between the rear panel and the phosphor layer, and a dielectric layer is preferably arranged between the phosphor layer and the address electrodes.

The front discharge electrodes preferably extend in one direction, and the rear discharge electrodes preferably extend to cross the front discharge electrodes.

According to yet another aspect of the present invention, a Plasma Display Panel (PDP) is provided comprising: a front panel; a rear panel parallel to and separated from the front panel; a plurality of first barrier ribs of a dielectric, the plurality of first barrier ribs being arranged between a front panel and a rear panel and adapted to define discharge cells together with the front panel and the rear panel by including a plurality of surfaces adapted to surround sides of each discharge cell and meet at a rounded corner; a plurality of front discharge electrodes and rear discharge electrodes separated from each other within the plurality of first barrier ribs and adapted to surround each discharge cell; a phosphor layer adapted to emit visible light in response to receiving ultraviolet rays, the phosphor layer being arranged in each discharge cell; and a discharge gas filling each discharge cell.

At least some of the plurality of first barrier ribs are preferably covered by a protective layer having a plurality of surfaces that meet at an obtuse angle.

The PDP preferably further comprises a plurality of second barrier ribs adapted to define the discharge cells together with the plurality of first barrier ribs, the plurality of second barrier ribs being arranged between the first plurality of barrier ribs and the rear panel, and the plurality of second barrier ribs including a plurality of surfaces adapted to surround sides of each discharge cell and meet at an obtuse angle.

At least one of the front and rear discharge electrodes preferably includes a plurality of inner surfaces adapted to surround each discharge cell and meet each other with rounded inner corners, the plurality of inner surfaces preferably arranged separately in the plurality of first barrier ribs.

The inner corner of the electrodes and the corner of the plurality of barrier ribs are preferably rounded with a radius of 5-50% of the width of a surface adjacent to the inner corner of the electrodes.

At least one of the front and rear discharge electrodes preferably includes a plurality of outer surfaces that meet each other with rounded outer corners.

The outer corner and the inner corners are preferably rounded with the same radius.

The front and rear discharge electrodes preferably extend in one direction, and the PDP preferably further comprises address electrodes extending to cross the front and rear discharge electrodes.

The address electrodes are preferably arranged between the rear panel and the phosphor layer, and a dielectric layer is preferably arranged between the phosphor layer and the address electrodes.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
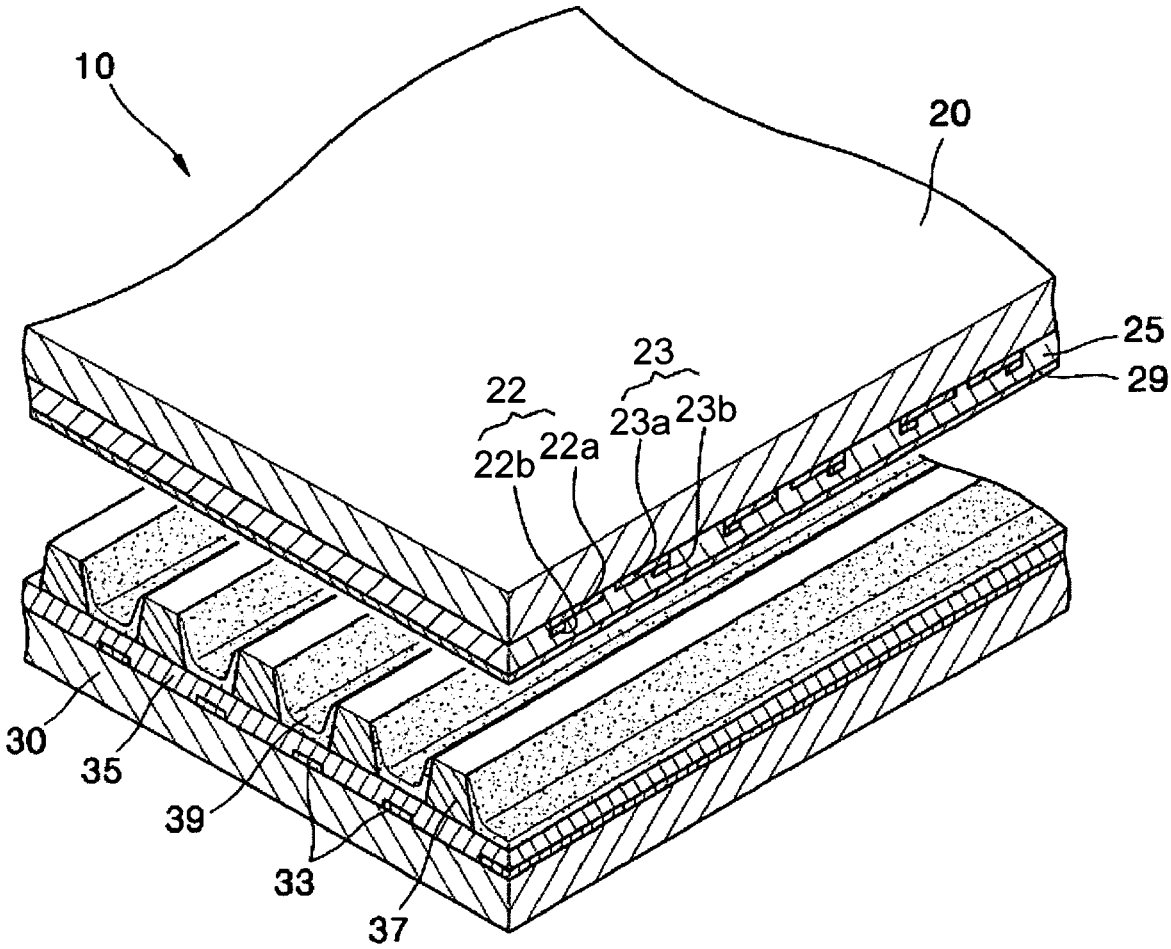
FIG. 1 is an exploded perspective view of an AC three-electrode surface PDP.

FIG. 1 is a perspective view of an AC three-electrode surface discharge PDP discussed in U.S. Pat. No. 6,753,645. Referring to FIG. 1, AC three-electrode surface discharge PDP 10 includes a front panel 20 and rear panel 30.

The rear panel 30 includes address electrodes 33 that generate an address discharge, a rear dielectric layer 35 that covers the address electrodes 33, a plurality of barrier ribs 37 that define discharge cells, a phosphor layer 39 coated onto both the side walls of the barrier ribs 37 and the rear panel 30 between the barrier ribs 37.

The front panel 20, facing the rear panel 30, includes X and Y electrodes 22 and 23 that generate a sustain discharge, a front dielectric layer 25 that covers the X and Y electrodes, and a protective layer 29. The X electrode 22 can include a transparent X electrode 22*a*, and a bus X electrode 22*b* on one side of the transparent X electrode 22*a* to avoid a voltage loss in the transparent X electrode 22*a*. The Y electrode 23 can include a corresponding transparent Y electrode 23*a* and bus Y electrode 23*b*.

However, in the PDP 10, visible light is generated in the discharge space and must pass through the transparent X electrode 22*a*, the bus X electrode 22*b*, the transparent Y electrode 23*a*, the bus Y electrode 23*b*, the front dielectric layer 25, and the protective layer 29, formed on the front panel 20. This reduces the transmittance of the visible light to approximately 60%.

Also, in the surface discharge PDP 10, electrodes that generate discharge are formed on the upper surface of the discharge space, that is, the inner surface of the front panel 20. For this reason, the discharge begins at the inner surface of the front panel 20 and diffuses into the discharge space, thereby reducing the light emission efficiency.

Furthermore, in the surface discharge PDP 10, permanent latent images can form due to the sputtering of charged ions of the discharge gas by the electric field to the phosphor layer 39 after long hours of operation.

The present invention will now be described more fully with reference to the accompanying drawings, in which exemplary embodiments of the present invention are shown.

Figure 2:
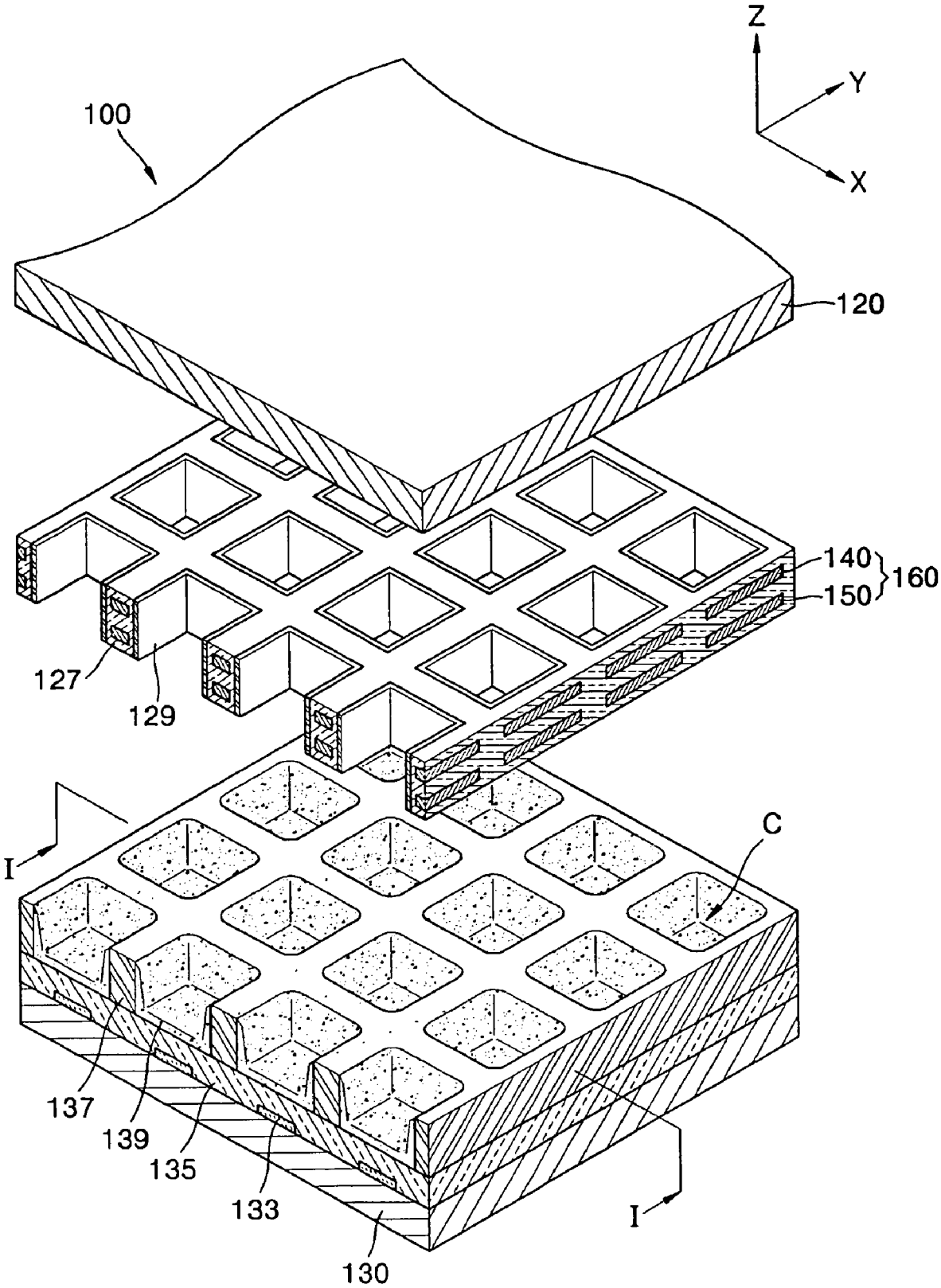
FIG. 2 is an exploded perspective view of a PDP according to a first embodiment of the present invention.
Figure 3:
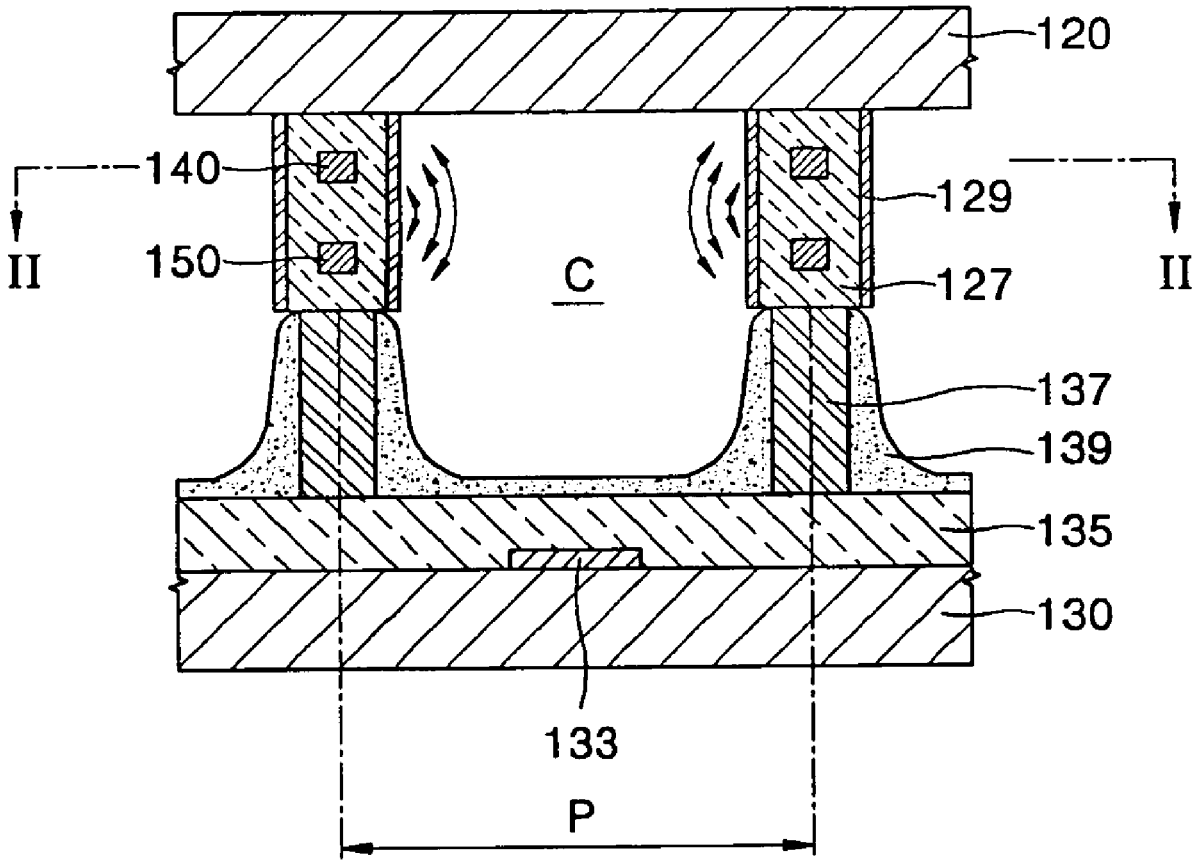
FIG. 3 is a cross-sectional view taken along line I-I of FIG. 2.

Referring to FIGS. 2 and 3, a plasma display panel (PDP) 100 according to a first embodiment of the present invention comprises a front panel 120, a rear panel 130, a plurality of first barrier ribs 127, a plurality of discharge electrodes 160, a phosphor layer 139, a plurality of address electrodes 133, and a discharge gas (not shown).

The front panel 120, is transparent so that visible light can pass therethrough to form the image. The front panel 120 is located in front (z direction) of the rear panel 130 and is parallel to the rear panel 130. The first barrier ribs 127 are formed between the front panel 120 and the rear panel 130. The first barrier ribs 127 are disposed at a non-discharge region and define discharge cells C. Discharge electrodes 160 are located in the first barrier ribs 127. The discharge electrode 160 includes front discharge electrodes 140 and rear discharge electrodes 150 spaced apart from each other and formed to surround the discharge cells C.

The phosphor layer 139 is located in a space defined by the first barrier ribs 127, the front panel 120, and the rear panel 130. The phosphor layer 139 can emit red, green or blue light.

A discharge gas (not shown) fills the discharge cells.

The front panel 120 is formed of a transparent material having a high light transmittance, such as glass, and visible light is emitted to the outside through the front panel 120.

The first barrier ribs 127 are formed of a dielectric and define adjacent discharge cells, prevent cross-talk between the front discharge electrode 140 and the rear discharge electrode 150, prevent damage to the electrodes 140 and 150 due to collision of charged particles, and accumulate wall charges by inducing charged particles.

A plurality of second barrier ribs 137 can be disposed between the first barrier ribs 127 and the rear panel 130. In this case, the second barrier ribs 137 are located between the first barrier ribs 127 and the rear panel 130, to define discharge cells C together with the first barrier ribs 127, and to prevent unwanted discharge between the discharge cells C. In FIG. 2, the second barrier ribs 137 define the discharge cells C in a matrix pattern, but the present invention is not limited thereto, and can use a honeycomb or other pattern. Also, the discharge cells C are shown with a rectangular cross-section, but the present invention is not limited thereto, and can use a polygon shape such as a triangle or pentagon, or a circle or oval shape.

The first barrier ribs 127 and the second barrier ribs 137 can be formed as a unitary body.

The front discharge electrode 140 and the rear discharge electrodes 150 are formed in the first barrier ribs 127. The front discharge electrode 140 and the rear discharge electrodes 150 can be formed of a conductive metal such as Ag, Al, or Cu.

Figure 4:
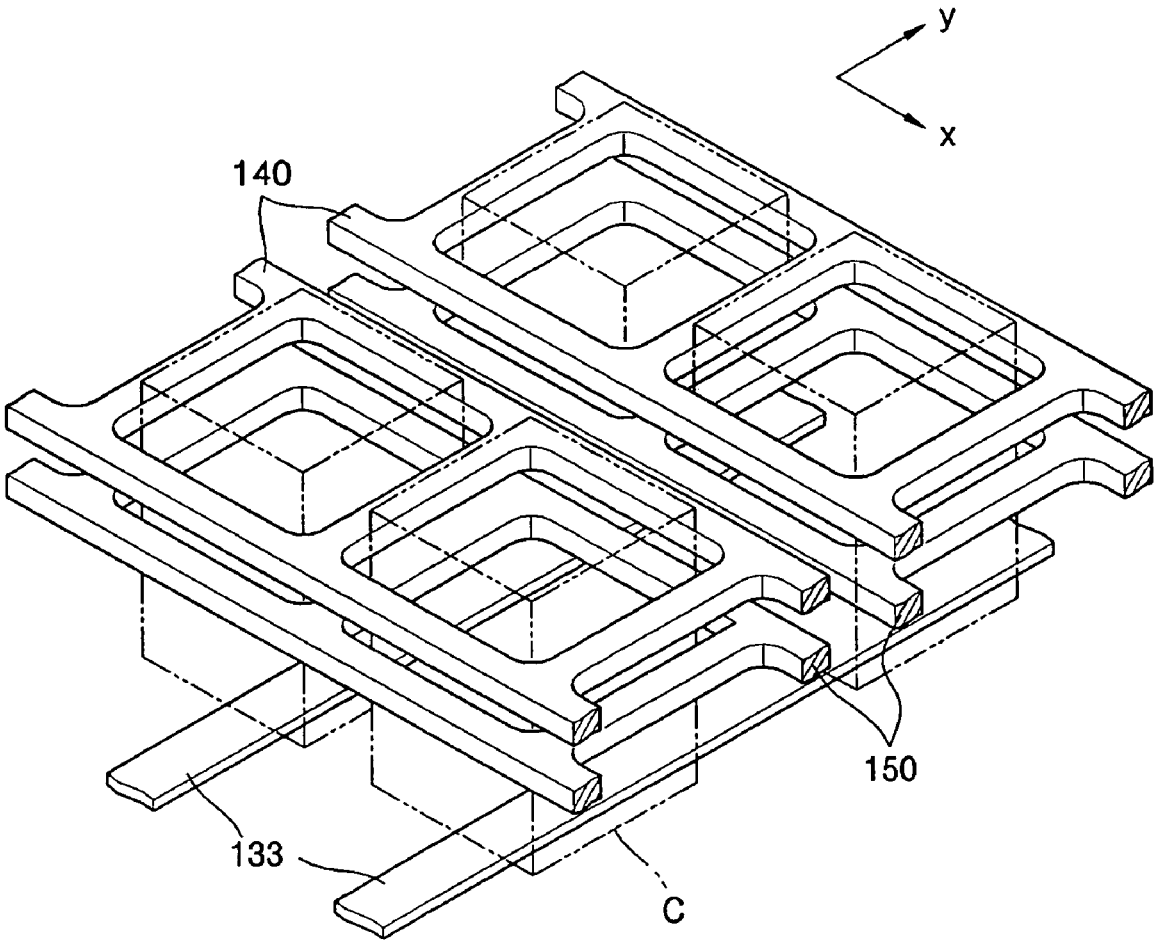
FIG. 4 is a perspective view of electrodes on the PDP of FIG. 2.

In this case, referring to FIG. 4, the front discharge electrodes 140 and the rear discharge electrodes 150 extend parallel to each other, and the address electrodes 133 can extend in a direction (y direction) crossing the front discharge electrodes 140 and the rear discharge electrodes 150. The columns of the discharge cells C defined by the address electrodes 133 cross the columns of discharge cells C defined by the front discharge electrodes 140 and the rear discharge electrodes 150. Also, the front discharge electrode 140 and the rear discharge electrodes 150 extend in parallel and are spaced apart by a predetermined distance.

The front discharge electrode 140 and the rear discharge electrodes 150 generate sustain discharges.

The address electrodes 133 aid the generation of sustaining discharges between the rear discharge electrodes 150 and the front discharge electrodes 140, by reducing the breakdown voltage needed for the sustaining discharge.

The address electrodes 133 are located between the rear panel 130 and the phosphor layer 139, and a dielectric layer 135 can be formed between the address electrodes 133 and the phosphor layer 139. The rear panel 130 supports the address electrodes 133 and the dielectric layer 135. As described above, the address electrodes 133 can be covered by the dielectric layer 135.

The dielectric layer 135 can be formed of a dielectric that can prevent damage to the address electrodes 133 due to collision of positive ions or electrons during discharge, and can induce a charge. The dielectric can be an oxide such as PbO, $B_2O_3$, or $SiO_2$.

Assuming that the rear discharge electrode 150 functions as the Y electrode and the front discharge electrode 140 functions as the X electrode, an address discharge occurs between the rear discharge electrode 150 and the front discharge electrode 140. When the address discharge ends, positive ions are accumulated on the rear discharge electrode 150, and electrons are accumulated on the front discharge electrode 140, thereby encouraging the sustain discharge between the rear discharge electrode 150 and the front discharge electrode 140.

In FIG. 2, the rear discharge electrode 150 and the front discharge electrode 140 are each formed of one electrode, but can alternatively each include more than two sub-electrodes.

The first barrier ribs 127 can be covered by a protective layer 129. The protective layer 129 is not a requisite element, but it helps prevent damage to the first barrier ribs 127 due to collision of charged particles, and facilitates the generation of secondary electrons during discharge.

The phosphor layer 139 is formed in the discharge cells C. If the second barrier ribs 137 are included in the PDP 100, the phosphor layer 139 is located in a space defined by the second barrier ribs 137. In this case, the phosphor layer 139 can be located on the same level as the second barrier ribs 137. That is, it is desirable for the sustaining discharge to be encouraged and a high memory characteristic can be achieved, by forming the first barrier ribs 127 using a dielectric, and the generation of visible light can be achieved by forming the phosphor layer 139 on the second barrier ribs 137 formed under the first barrier ribs 127.

The front discharge electrode 140 and the rear discharge electrode 150 are formed to surround the upper part of the discharge cells C, which is higher than the phosphor layer 139 formed on the second barrier ribs 137, when the second barrier ribs 137 are included.

The phosphor layer 139 includes a phosphor that emits visible light upon receiving ultraviolet rays generated by the sustain discharge. A red phosphor layer 139R formed in a red light emitting sub-pixel includes a phosphor such as $Y(V,P)O_4$:Eu; a green phosphor layer 139G formed in a green light emitting sub-pixel includes a phosphor such as $Zn_2SiO_4$:Mn, or $YBO_3$:Tb; and a blue phosphor layer 139B formed in a blue light emitting sub-pixel includes a phosphor such as BAM:Eu.

The discharge gas 140 filling the discharge cells C can be a penning mixture gas such as Xe—Ne, Xe—He, or Xe—Ne—He. Xe gas is used as the main discharge gas, since Xe gas is inert and does not dissociate in the discharge. An excitation voltage can be reduced, since Xe gas has a high atomic number, and long wavelengths of light are emitted. He or Ne is used as a buffer gas, since they can reduce the voltage drop by the penning effect caused by Xe and can reduce sputtering by high pressure.

The transparent Y electrode 23*a*, the transparent X electrode 22*a*, the bus X electrode 22*b*, the bus Y electrode 23*b*, the front dielectric layer 25, and the protective layer 29 are not included in the front panel 120 of the present embodiment. Therefore, the transmittance of visible light passing through the front panel 120 is increased to 90%, from the conventional rate of 60%. Accordingly, for a given brightness level, the electrodes 140 and 150 can be operated at a lower driving voltage than in the conventional art, thereby improving the light emission efficiency.

Furthermore, instead of transparent electrodes having a high resistance, the discharge electrodes can be metal electrodes having a low resistance, since the front discharge electrode 140 and the rear discharge electrode 150 are located on the side of the discharge space instead of on the front panel 120. This also allows a quick discharge response and a low driving voltage without the distortion of waveforms.

Figure 5:
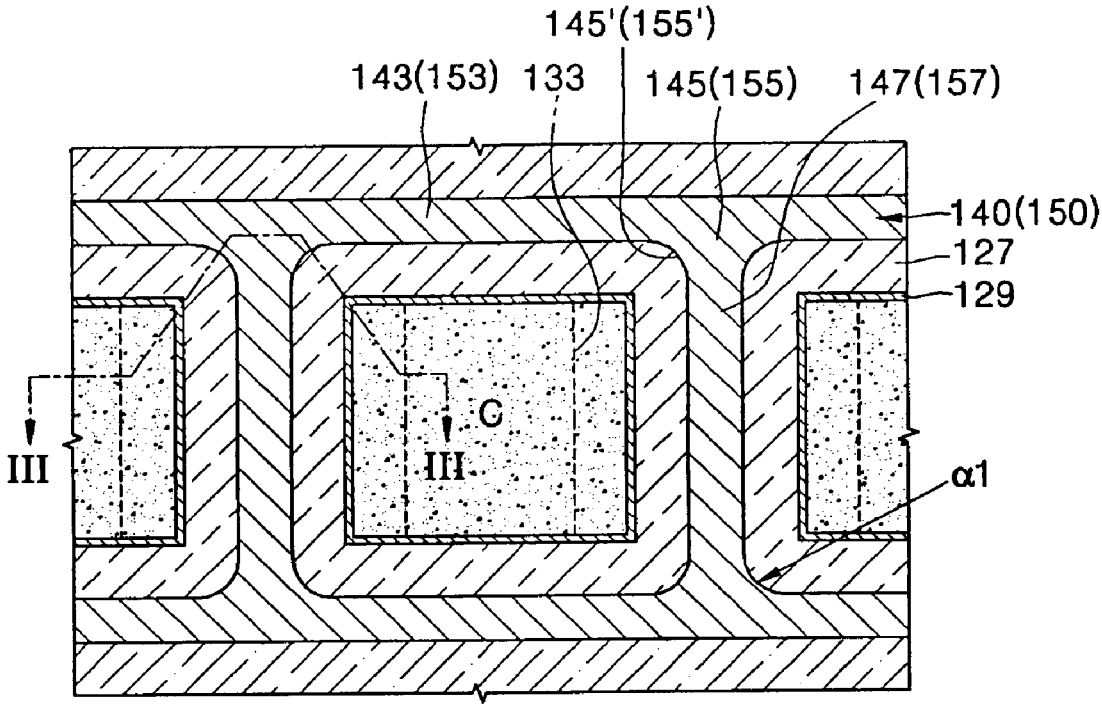
FIG. 5 is a cross-sectional view taken along line II-II of FIG. 3.

The first and second discharge electrodes each includes main line parts, such as horizontal parts 143 and 153 and vertical parts 144 and 154, and corner parts 145 and 155 where the main line parts meet. An inner surface of the corner parts 145 and 155 are rounded A case where the front discharge electrode 140 and the rear discharge electrode 150 are rectangular will now be described. Referring to FIG. 5, the front discharge electrode 140 and the rear discharge electrode 150 each include horizontal parts 143 and 153, vertical parts 147 and 157, and corner parts 145 and 155. As depicted in FIG. 2 through 4, the horizontal parts 143 and 153 indicate electrodes formed in a direction (x direction) crossing the address electrodes 133, and the vertical parts 147 and 157 indicate electrodes formed in a direction (y direction) parallel to the address electrodes 133.

In the present invention, inner surfaces 145' and 155' of the corner parts 145 and 155 that connect the horizontal parts 143 and 153 and the vertical parts 147 and 157 are rounded, to prevent unwanted discharge in the discharge cells C and to concentrate the electric field in the center part of the discharge cells C by preventing edge-curls at the corner parts 145 and 155. The inner surfaces of the corner parts 145' and 155' are the side surfaces of the corner parts 145 and 155, these surfaces being located close to the discharge cells C.

The formation of edge-curls will now be described with reference to FIGS. 5 and 6. Conventionally, the method of manufacturing the front discharge electrode 140 and the rear discharge electrode 150 of a conductive metal such as Al, Cu, or Ag includes drying, exposing, developing, and annealing.

The method of manufacturing the front discharge electrode 140 and the rear discharge electrode 150 by photolithography using an Ag photosensitive paste will now be described as an example. An Ag photosensitive paste layer is formed by printing. The Ag photosensitive paste layer is then dried to remove the solvent. Exposed areas and non-exposed areas are formed on the Ag photosensitive paste layer in an electrode pattern by exposure to ultraviolet rays using a photo-mask. The exposed areas become a bus electrode pattern in a subsequent process.

The exposed areas are fixed on a front barrier rib by a developing process. The resultant product is annealed, and then the annealed electrode precursors become the front discharge electrode 140 and the rear discharge electrode 150.

When a conductive metal photosensitive paste is patterned by photolithography, the paste must be annealed to remove a resin component from the paste. At this time, edge-curls Ec are generated. That is, a binder that binds the solvent and the conductive metal photosensitive paste escapes due to the high annealing temperature, and surfaces other than the corners contract due to surface tension, causing the corners to roll up.

When edge-curls Ec are generated, it is difficult to form a dielectric layer on the edge-curls Ec, and a correct dielectric pattern cannot be formed due to a sharp surface angle at the corner parts 145 and 155 after annealing, when forming the dielectric layer.

Figure 6:
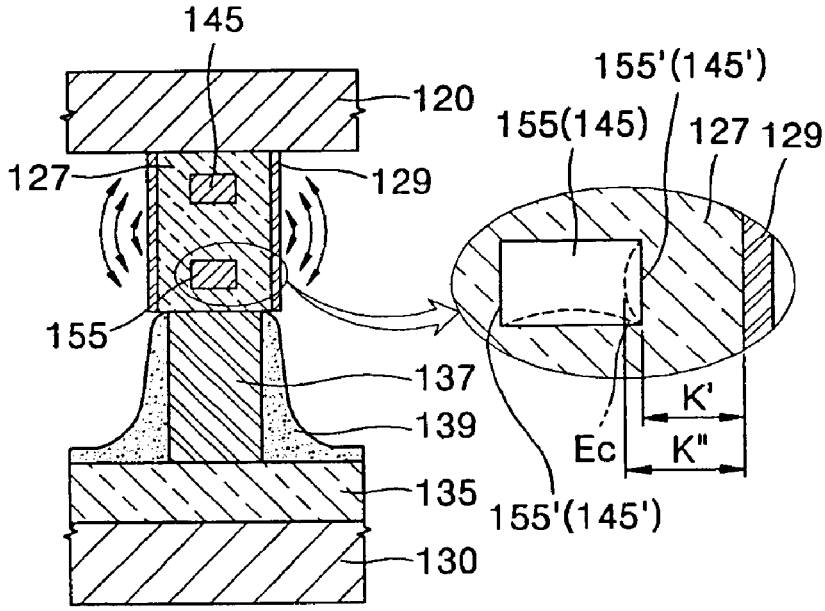
FIG. 6 is a cross-sectional view taken along line III-III of FIG. 5.

Referring to FIG. 6, if edge-curls Ec are generated on inner corners 145' and 155', electric fields are concentrated on a sharp portion of the edge-curls Ec, while driving the PDP. The thickness K' of the dielectric layer where the edge-curls Ec are formed is less than the thickness K" of other parts of the dielectric layer. For this reason, the insulation of the first barrier ribs 127 corresponding to the edge-curls Ec is readily broken. The concentration of electric fields and breakdown of the insulation causes a different migration of wall charges in a discharge cells C corresponding to the corner parts 145 and 155 than when discharging, thereby generating an unwanted discharge. When an unwanted discharge is generated, the electric field can not be effectively concentrated in the center of the discharge cells C, which results the reduction of the overall discharge volume, thereby reducing light emission efficiency.

Therefore, as depicted in FIGS. 4 and 5, inner corners 145' and 155' of the front discharge electrode 140 and the rear discharge electrode 150 can be rounded to prevent the generation of edge-curls Ec.

In this case, the inner corners 145' and 155' can be formed to have a radius of at least 5% of the width of a surface adjacent to the inner surfaces. That is, the inner corners 145' and 155' can be rounded with a radius $\alpha 1$ of at least 5% of a distance P between the centers of adjacent first barrier ribs 127. If the radius $\alpha 1$ is less than 5%, edge-curls Ec cannot be prevented and the electric fields cannot be concentrated in the central part of the discharge cells C. Also, the inner corners 145' and 155' can be formed to have a radius $\alpha 1$ of a maximum of 50% of the width of a surface adjacent to the inner surfaces.

Figure 7:
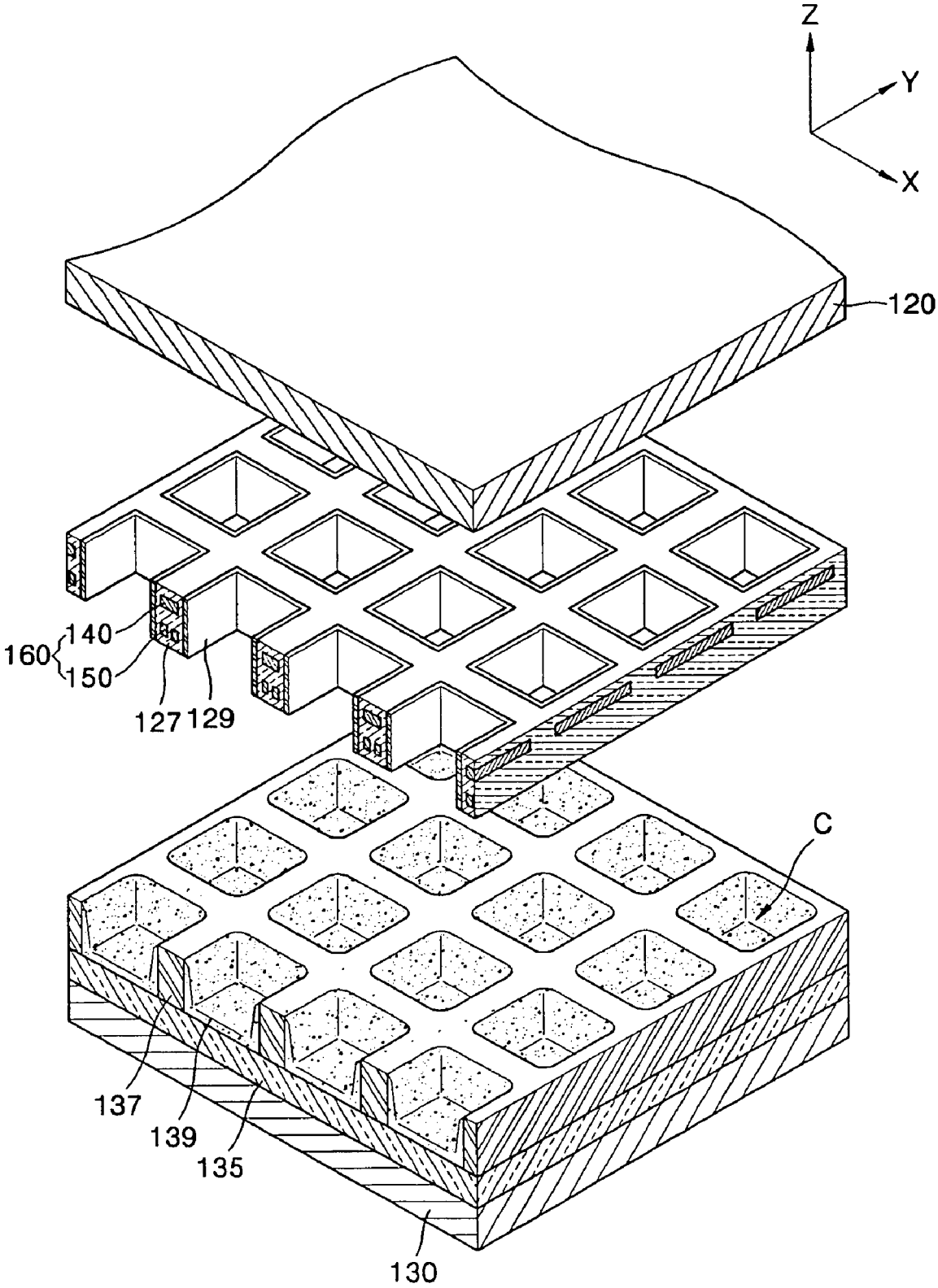
FIG. 7 is an exploded perspective view of a first modified version of the PDP of FIG. 2.
Figure 8:
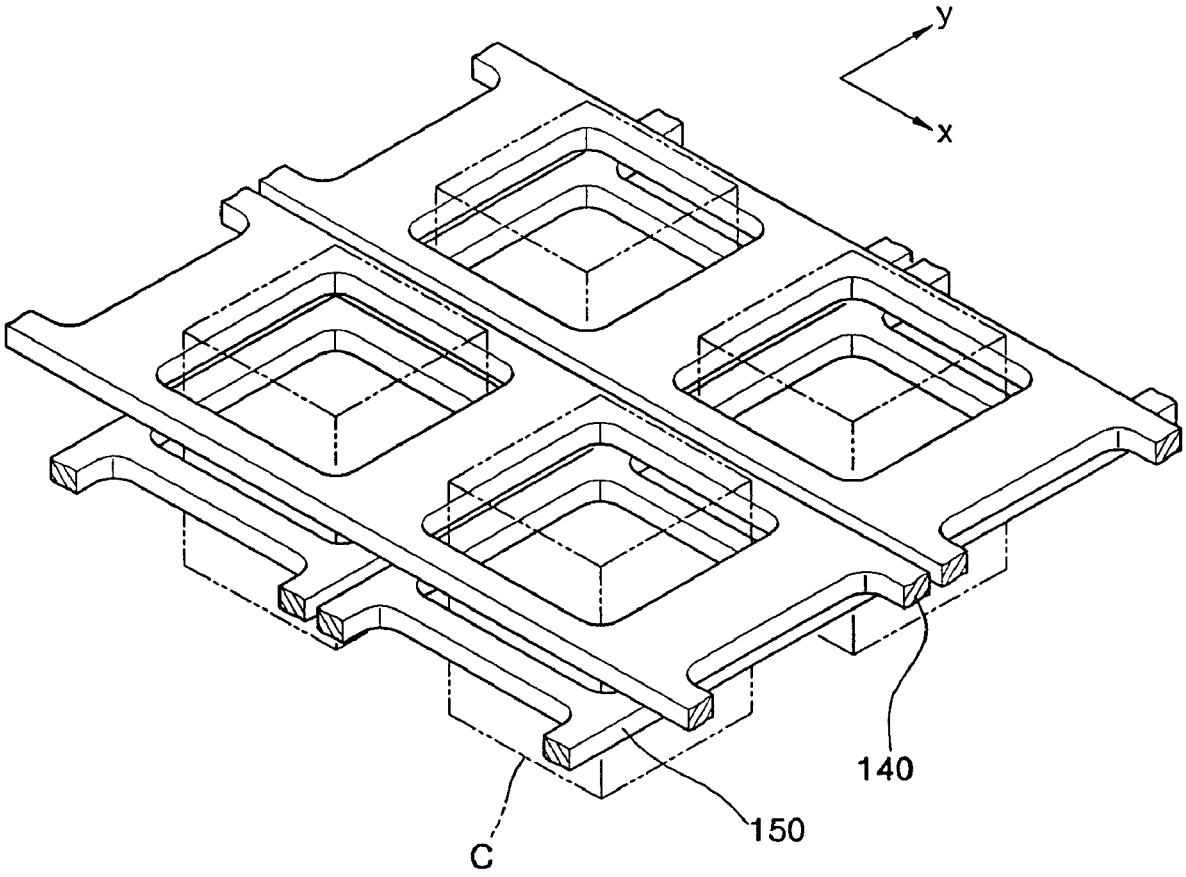
FIG. 8 is a perspective view of the locations of front discharge electrodes, rear discharge electrodes, and address electrodes.

Referring to FIGS. 7 and 8, the front discharge electrode 140 and the rear discharge electrode 150 can cross each other. Address electrodes are not formed, but the front and rear discharge electrodes 140 and 150 can function as the address electrodes. The dielectric layer that covers the address electrodes is not needed, since there are no address electrodes.

The front discharge electrode 140 can extend along the discharge cells C formed in the x direction, and the rear discharge electrode 150 can extend along the discharge cells C formed in the y direction, crossing the front discharge electrode 140. Either the front discharge electrode 140 or the rear discharge electrode 150 can function as both the address electrodes that generate an address discharge and the sustain electrodes that generate a sustain discharge.

The operation of the PDP 100 having the above structure will now be described. Referring to FIG. 3, it is assumed that the rear discharge electrode 150 functions as the address electrodes 133 and the scan electrode that generates an address discharge and the front discharge electrode 140 functions as the common electrode that generates a sustain discharge together with the rear discharge electrode 150.

An address discharge is generated when an address voltage is supplied between the address electrodes 133 and the rear discharge electrode 150. As a result of the address discharge, a discharge cell C is selected in which a sustain discharge occurs.

When an AC sustain discharge voltage is supplied between the front discharge electrode 140 and the rear discharge electrode 150 of the selected discharge cell C, a sustain discharge occurs therebetween. Ultraviolet rays are generated by the discharge gas excited by the sustain discharge due to a reduction in the energy level of the discharge gas. The ultraviolet rays excite the phosphor layer 139 in the discharge cell C, and visible light is emitted from the phosphor layer 139 due to a reduction in the energy level of the phosphor layer 139. The visible light emitted by the phosphor layer 139 forms the final image.

Figure 9:
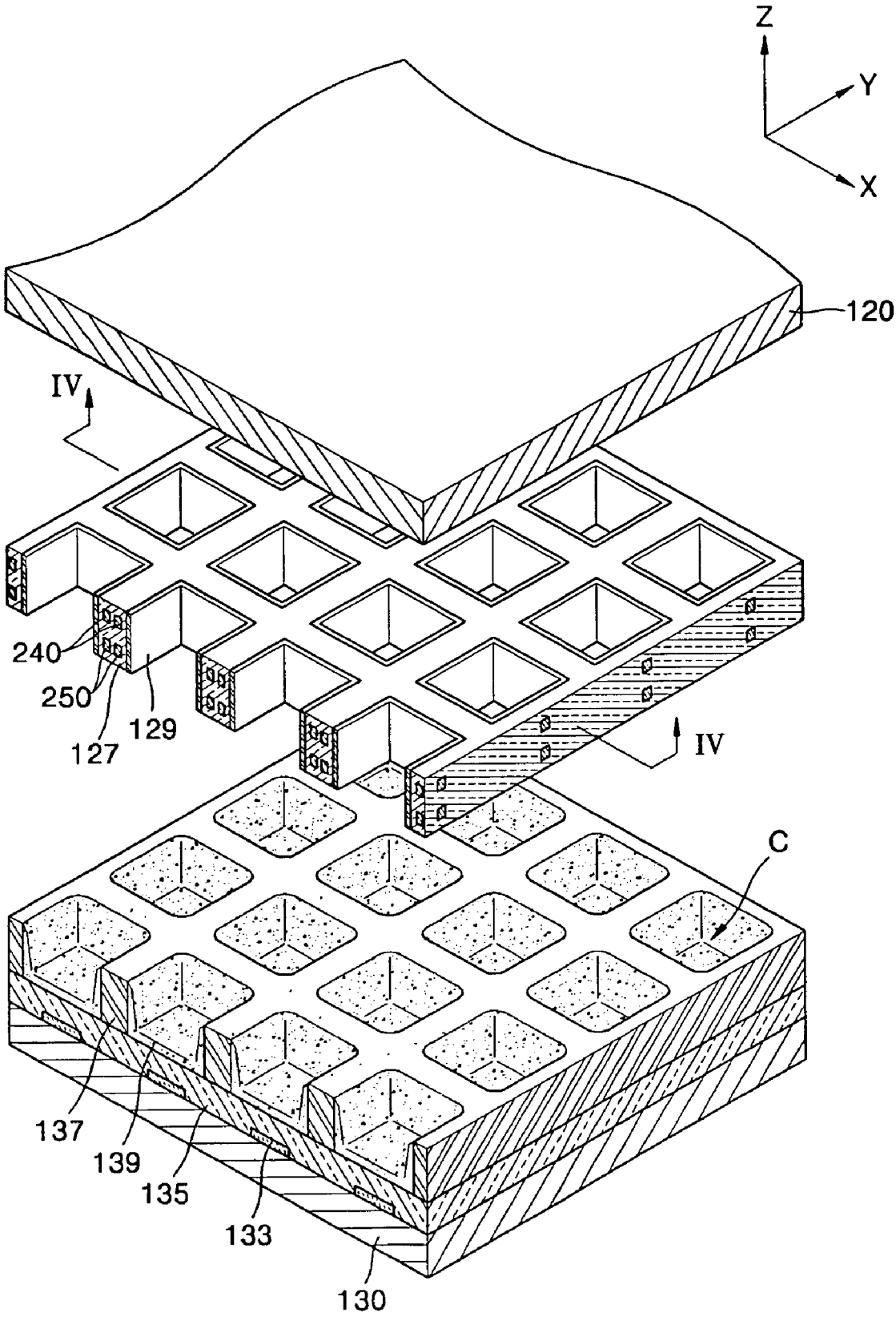
FIG. 9 is an exploded perspective view of a second modified version of the PDP of FIG.2.
Figure 10:
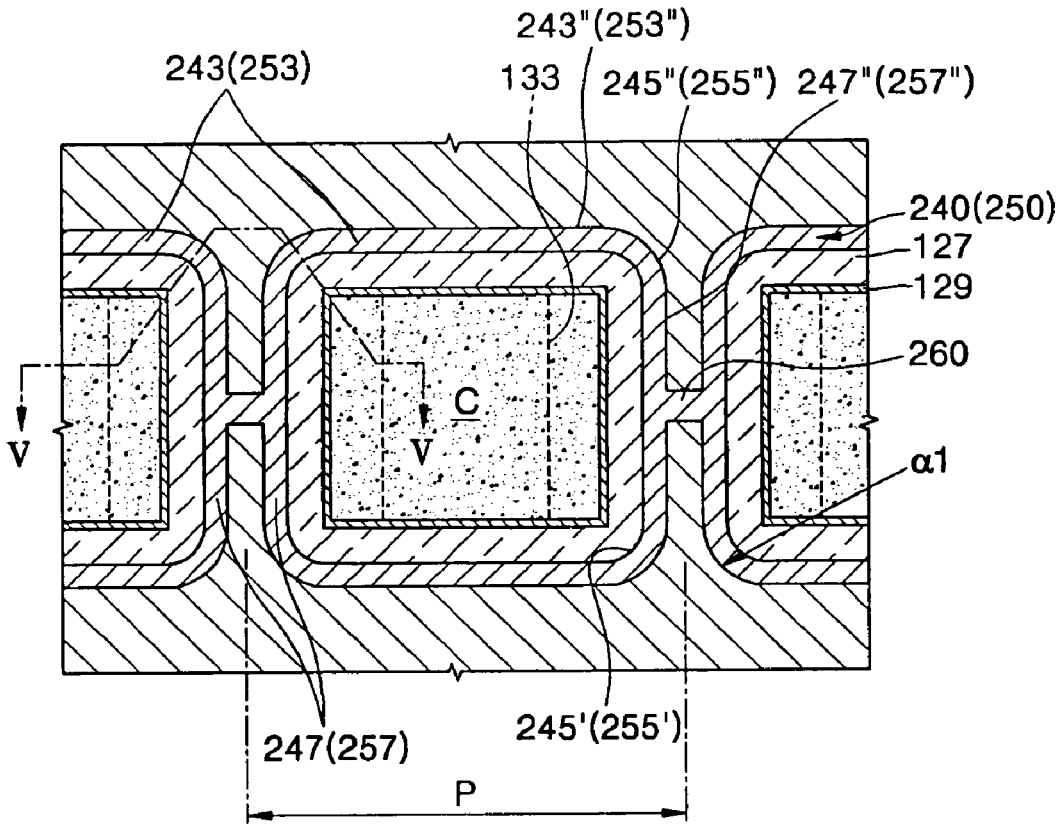
FIG. 10 is a cross-sectional view taken along line IV-IV of FIG. 9.

FIGS. 9 and 10 are views of a front discharge electrode 240 and a rear discharge electrode 250 according to a modified version of the first embodiment. The front discharge electrode 240 and the rear discharge electrode 250 can comprise horizontal parts 243 and 253, vertical parts 247 and 257, and corner parts 245 and 255 which combine to surround the discharge cell C at least in each cell.

That is, referring to FIG. 10, the front discharge electrode 240 and the rear discharge electrode 250 can include individual horizontal parts 243 and 253, vertical parts 247 and 257, and corner parts 245 and 255 that connect the horizontal parts 243 and 253 and the vertical parts 247 and 257. A connection unit 260 can be included to connect adjacent vertical parts 247 and 257. Also, the individual horizontal parts 243 and 253, the vertical parts 247 and 257, and the corner parts 245 and 255 can be formed only in alternate discharge cells C.

As depicted in FIG.10, as well as rounding inner corners 245' and 255' of the corner parts 245 and 255, outer surfaces 245" and 255" of the corner parts 245 and 255 that connect outer surfaces 243" and 253 " of the horizontal parts 243 and 253 and outer surfaces 247" and 257" of the vertical parts 247 and 257 can also be rounded.

Figure 11:
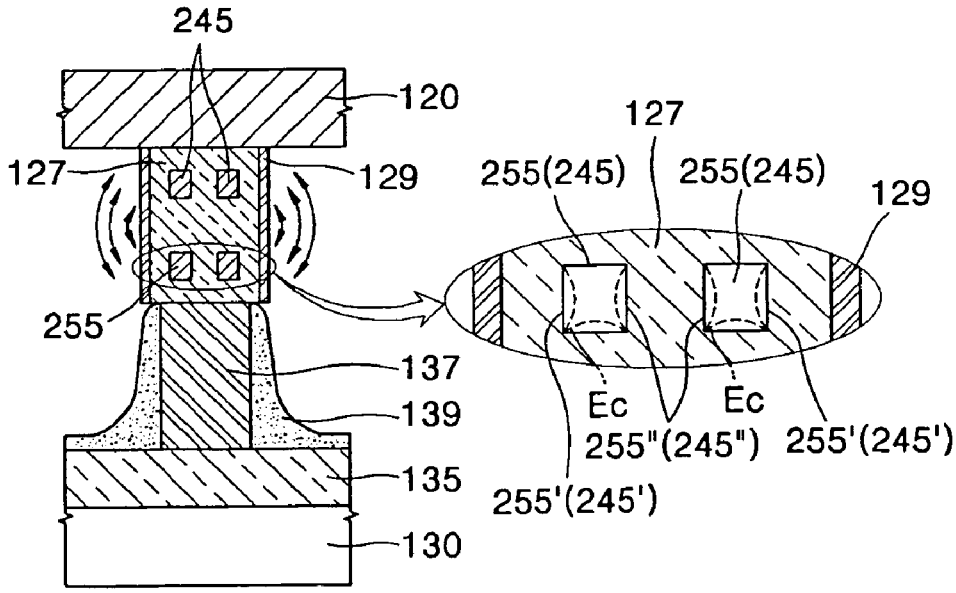
FIG. 11 is a cross-sectional view taken along line V-V of FIG. 10.

If the outer corners 245" and 255" of the corner parts 245 and 255 of the front discharge electrode 240 and the rear discharge electrode 250 are not rounded, as depicted in FIG. 11, the outer surfaces 245" and 255" of the corner parts 245 and 255 may have sharp edges, which can cause edge-curls Ec on the outer surfaces when manufacturing the front discharge electrode 240 and the rear discharge electrode 250. If edge-curls Ec form, a dielectric will be difficult to form on the edge-curls Ec, and can form with a defective pattern, since sharply angled corners 245 and 255 form after annealing.

Therefore, the outer surfaces 245" and 255" of the front discharge electrode 240 and the rear discharge electrode 250, and the inner surfaces 245' and 255', are preferably rounded.

The outer surfaces 245" and 255" of the corner parts 245 and 255 preferably have a radius $\alpha 2$ of at least 5% of the distance between the centers of adjacent front barrier ribs.

This is the minimum radius that can prevent the formation of edge-curls Ec on the outer surface of the corner parts 245 and 255. If the outer surfaces are formed with a radius of less than 5% of the distance between the vertical parts 247 and 257 that form discharge cells C, edge-curls Ec cannot be prevented and the electric field cannot be concentrated in the central part of the discharge cells C.

Figure 12:
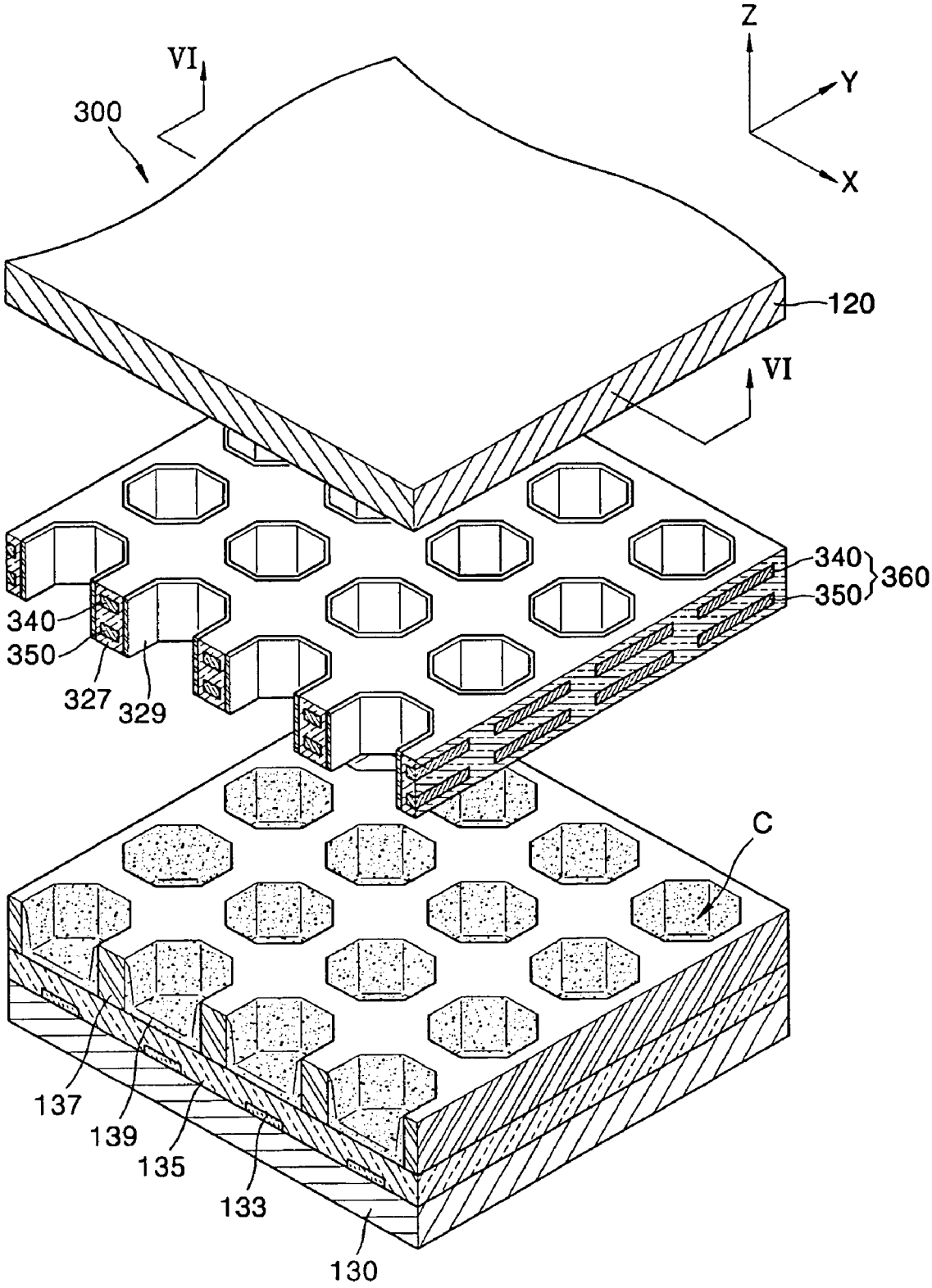
FIG. 12 is an exploded perspective view of a PDP according to a second embodiment of the present invention.

To generate a uniform sustain discharge in a discharge cell C, the shape of the discharge cell C preferably has no corners. For this purpose, referring to FIGS. 12 and 13, a PDP 300 according to a second embodiment of the present invention includes first barrier ribs 327 having corner parts **327*a* having an obtuse angle. The PDP 300 according to the second embodiment will now be described, focusing on the differences from the PDP 100** according to the first embodiment.

In the PDP 300 according to the second embodiment, an obtuse angle forms the inner surfaces of a discharge cell C adjacent to the corner parts **327*a* of the discharge cell C, giving the discharge cell C an octagonal cross-section. The cross-section of the discharge cell C is not limited thereto, but can be any polygon having an obtuse angle on at least one of the corner parts 327*a* of the first barrier rib 327. All of the angles of the corner parts 327*a* of the first barrier ribs 327 are preferably obtuse. The protective layer 329 can be formed to surround the first barrier rib 327, and the angle of corner parts 329*a* where side surfaces that form the protective layer 329** meet is preferably obtuse.

Figure 13:
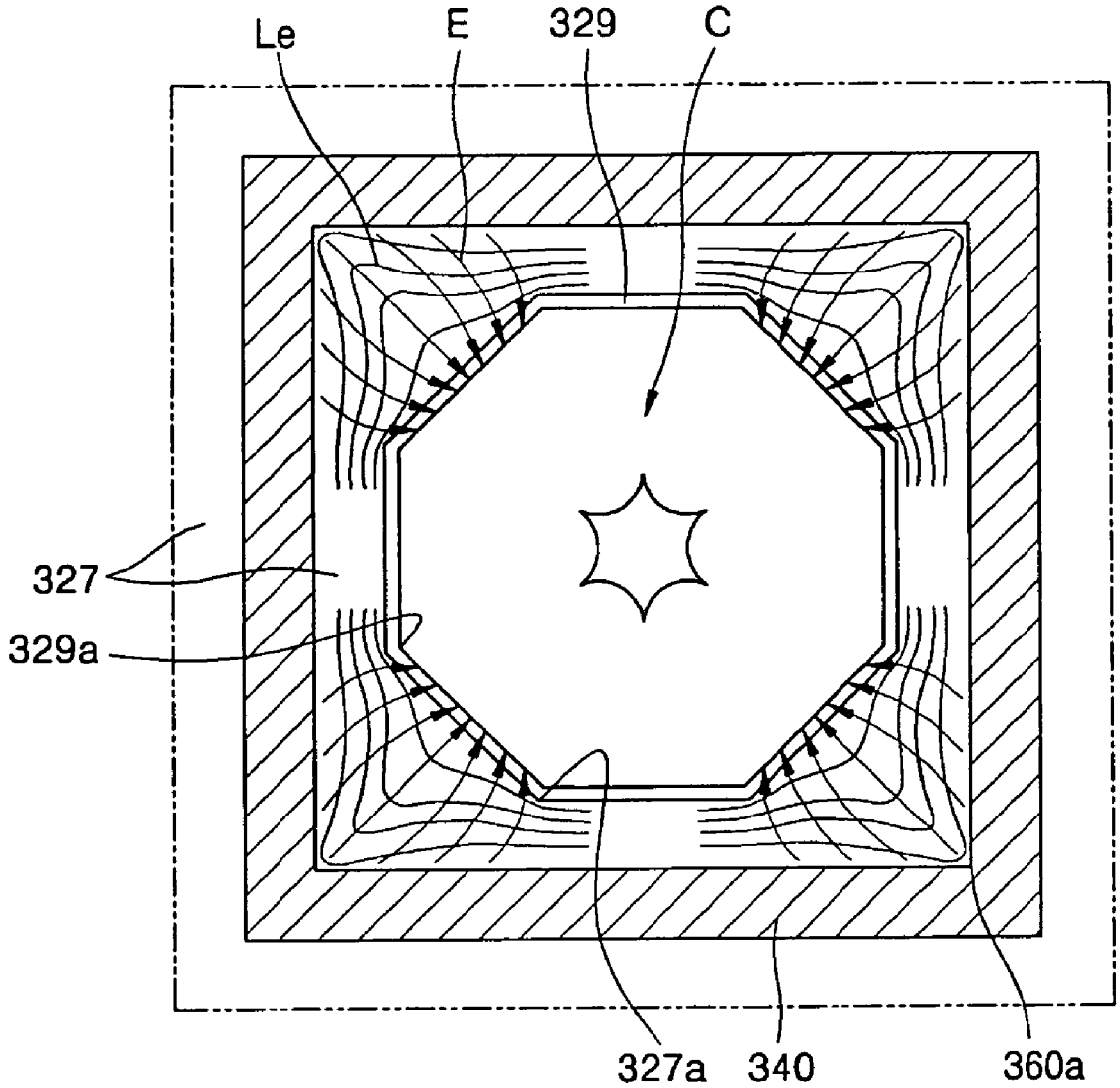
FIG. 13 is a cross-sectional view taken along line VI-VI of FIG. 12.

The advantages of the obtuse angle of the corner part 327*a* of the first barrier rib 327 will now be described with reference to FIG. 13. As depicted in FIG. 13, a contour potential surface Le having a rounded protrusion toward the corners of the discharge electrode is formed at the corner part 360*a* of the discharge electrode. Each surface of the first barrier rib induces wall charges and generates a discharge.

However, if the corner part 327*a* of the first barrier ribs 327 has an obtuse angle, the contour potential surface Le is formed along the shape of the corner part 327*a* of the first barrier ribs 327, since the charged particles are induced along the surfaces of the first barrier ribs 327 that form an obtuse angle. Accordingly, if the corner part 327*a* of the first barrier ribs 327 has an obtuse angle, a greater area of the contour potential surface Le is formed in the corner part 327*a* of the first barrier rib 327, since the adjacent surfaces that form a corner part 327*a* are opened wider than in the conventional art. That is, the radius of curvature of the contour potential surface Le formed in a rounded protrusion toward the corner part 327*a* of the discharge electrodes increases closer to the corner part 327*a* of the first barrier ribs 327, and as a result, a contour potential surface Le is formed on the inner surfaces of the corner part of the discharge cell C along the corner part 327*a* of the first barrier ribs 327 that form an obtuse angle.

Conventionally, the concentration of electric fields E is formed in a vertical direction of the contour potential surface Le. Therefore, the concentration of electric fields E on the corner part 327*a* of the first barrier rib 327 is less than when the corner part of the first barrier rib 327 has right angle, since the contour potential surface Le is greater.

This reduces the concentration of discharge in the corner part 327*a*, and increases the uniformity of discharge along the inner side surfaces of the discharge cell C. The uniform discharge in the discharge cell C enables the efficient use of discharge space, thereby increasing the efficiency of the PDP. Also, the increase in the discharge efficiency of the PDP can reduce the discharge breakdown voltage, which enables the PDP to use a low drive voltage. Therefore, the overall manufacturing cost of the PDP can be reduced, by using a cheaper driving circuit.

The corner part 327*a* of the first barrier rib 327 surrounding the discharge cell C can be formed in an obtuse angle, to form an obtuse angle between two adjacent surfaces of the corner part 327*a* of the discharge cell C. Alternately, the protective layer 329 coated on the side surface of the first barrier rib 327 can be thicker at the corner part 327*a*.

Figure 14:
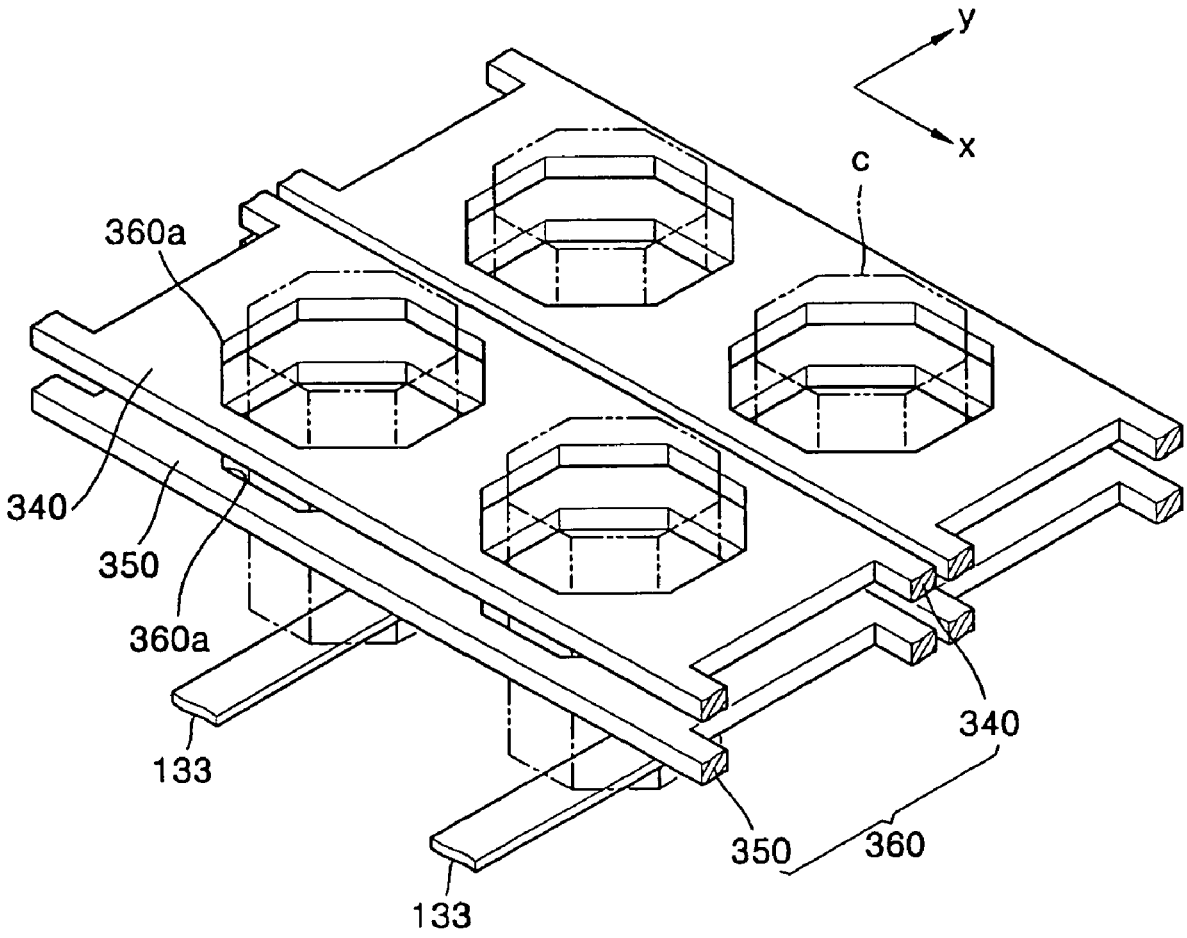
FIG. 14 is a perspective view of the locations of front discharge electrodes, rear discharge electrodes, and address electrodes.
Figure 15:
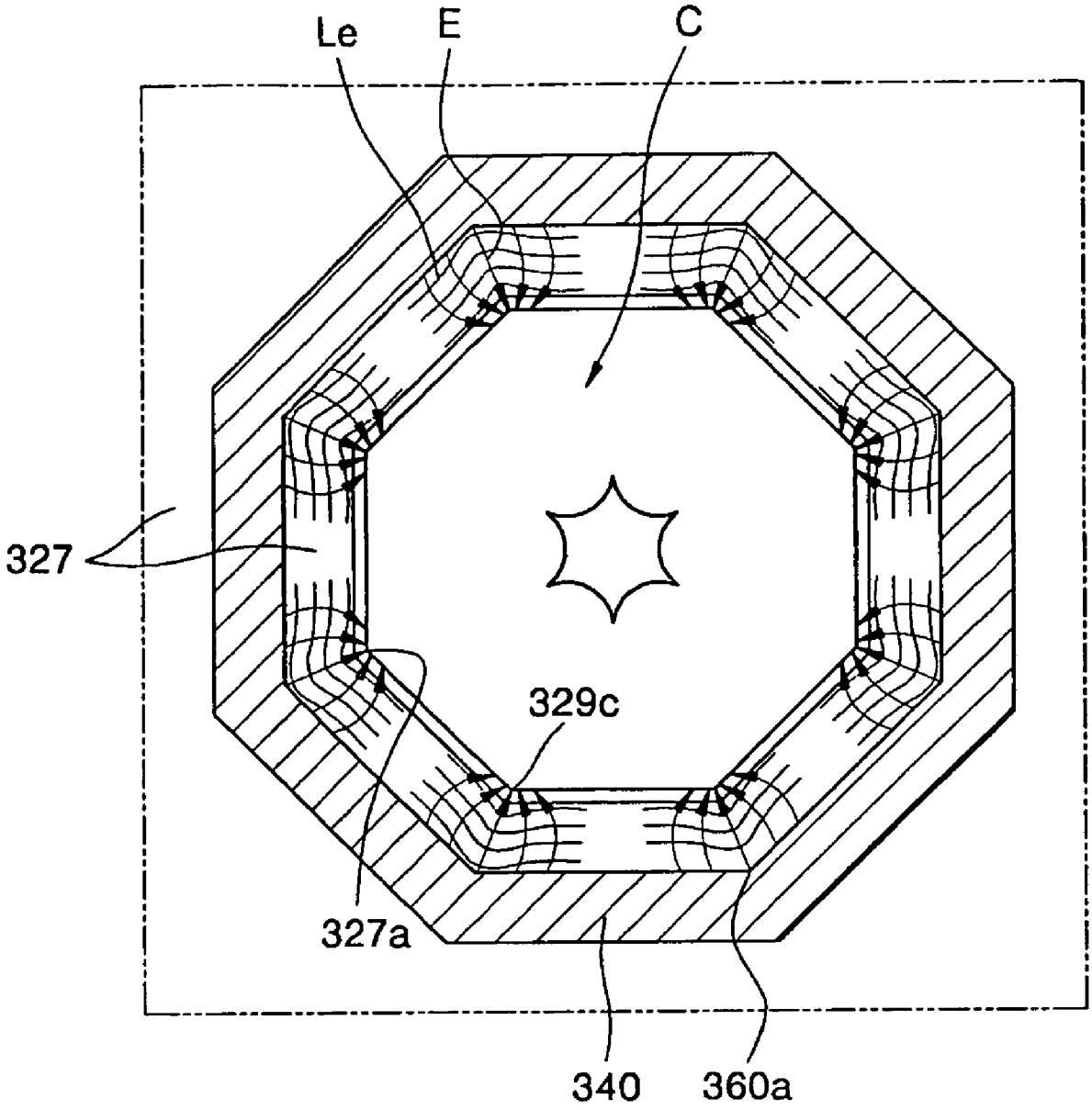
FIG. 15 is a cross-sectional view of a modified version of FIG. 13.

On the other hand, as well as the corner part 327*a* formed by two adjacent surfaces of the first barrier rib 327 having an obtuse angle, but also, as depicted in FIG. 14 and 15, an obtuse angle can be formed by two adjacent surfaces that form the corner part 360*a* of the discharge electrodes 360 surrounding the discharge cell.

If the corner part 360*a* of the discharge electrodes is formed in an obtuse angle, the radius of curvature of the contour potential surface Le generated at the corner part 360*a* of the discharge electrodes is greater than when the corner part is 90°.

Therefore, the concentration of electric fields E can be reduced at the corner part 360*a* of the discharge electrodes, and the concentration of discharge can be reduced at the corner part 327*a* of the first barrier rib 327, since the shape of the contour potential surface Le can be uniformly maintained to the inner surface of the first barrier rib 327.

The PDP 300 according to the second embodiment of the present invention can also be modified in the same way as the first embodiment, such that no address electrodes are formed in the PDP 300.

FIGS. 16 through 20 are views of a PDP 400 according to a third embodiment, as another example of the shape of the discharge cell C which does not have sharp corners.

Figure 16:
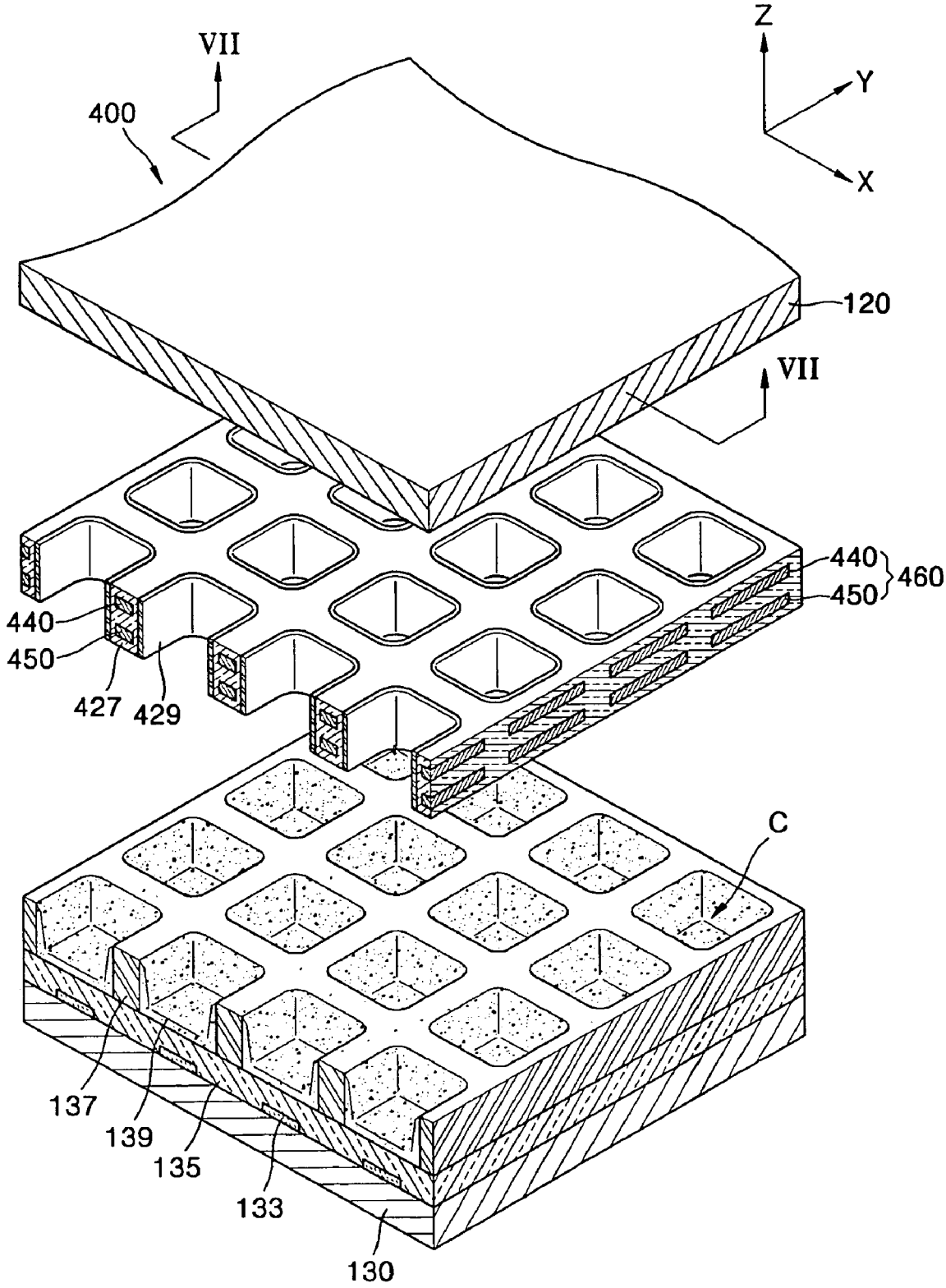
FIG. 16 is an exploded perspective view of a PDP according to a third embodiment of the present invention.
Figure 17:
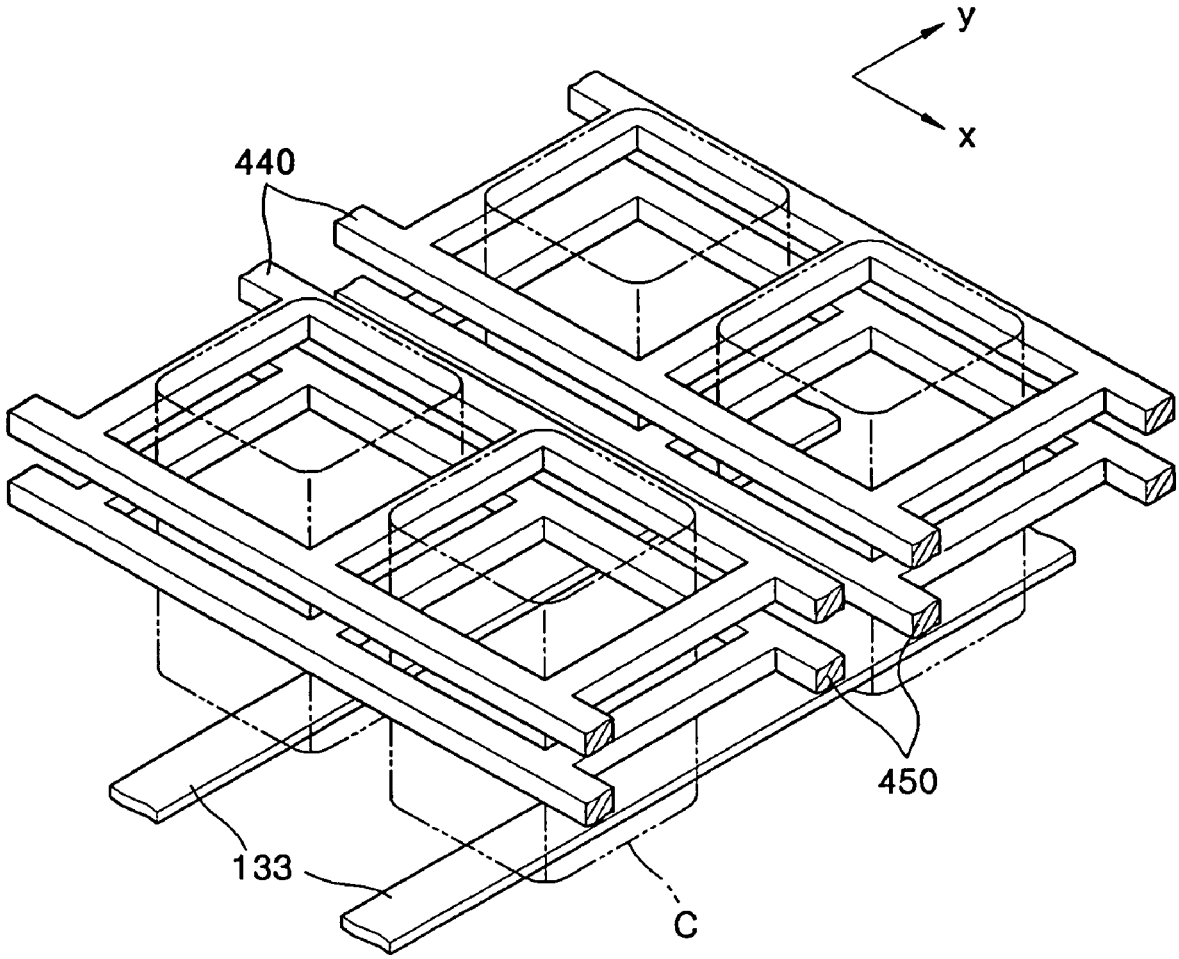
FIG. 17 is a perspective view of the locations of front discharge electrodes, rear discharge electrodes, and address electrodes.

A PDP 400 will now be described, focusing mainly on the differences from the first and second embodiments, with reference to FIGS. 16 through 20. Referring to FIGS. 16 and 17, the PDP 400 includes a first barrier rib 427 having side surfaces that meet with a rounded corner part.

Figure 18:
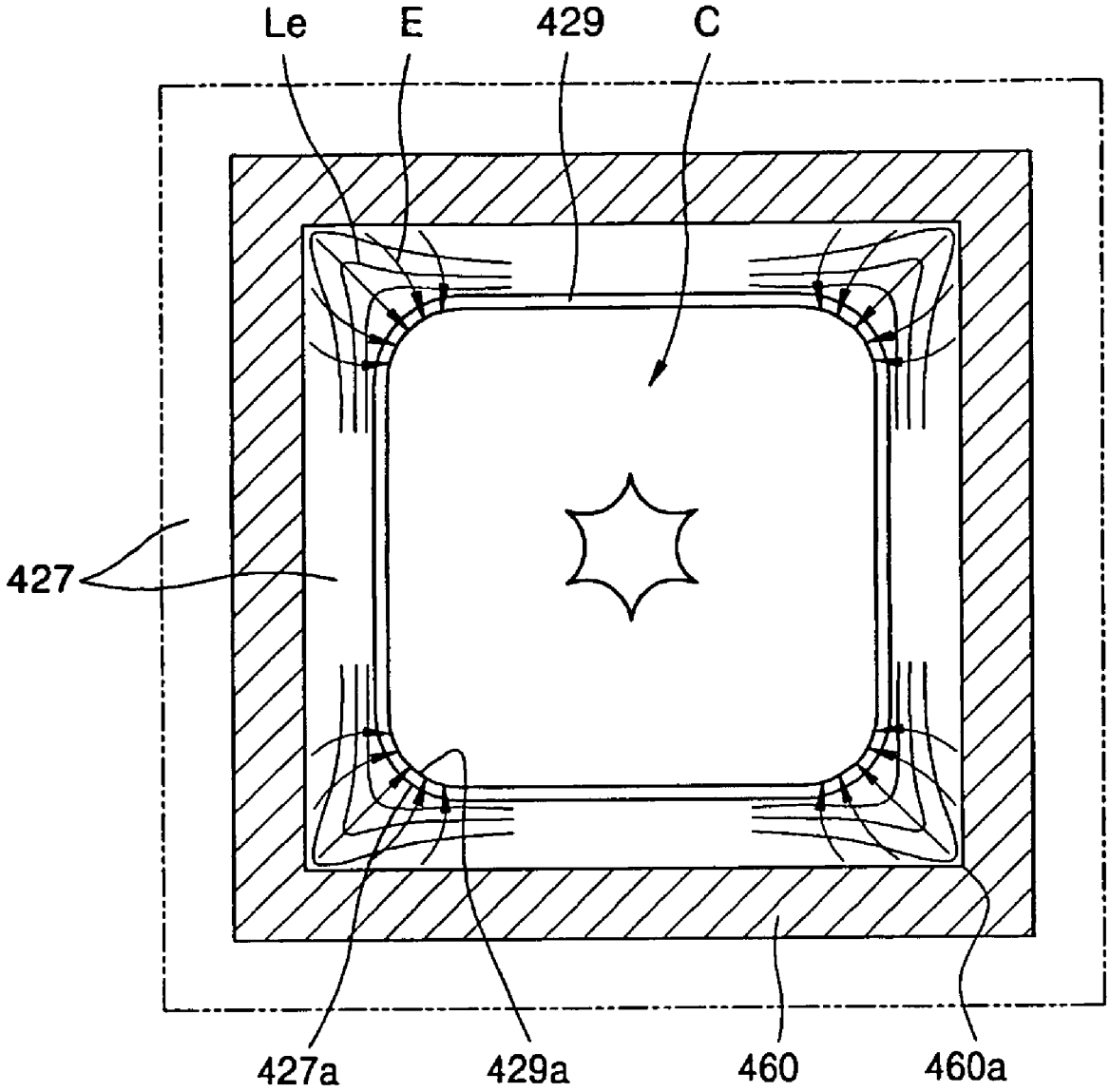
FIG. 18 is a cross-sectional view taken along line VII-VII of FIG. 16.

Referring to FIGS. 16 and 18, when a driving voltage is applied to a corner part 460*a* of the discharge electrodes 460, a contour potential surface Le is formed along an inner side surface of the discharge cell C by charged particles induced to the corner part 460*a* of the front discharge electrodes 440 and/or the rear discharge electrodes 450. Accordingly, if the corner part 427*a* of the first barrier rib 427 is round, the contour potential surface Le is also round to follow the corner part 427*a* of the first barrier rib 427. This prevents the concentration of electric field E at the corner part 427*a* of the first barrier rib 427, and enables a uniform discharge on the entire side surface of the discharge cell C.

The first barrier rib 427 can be covered by a protective layer 429. A corner part 429*a* where side surfaces of the protective layer 429 meets is preferably rounded.

Figure 19:
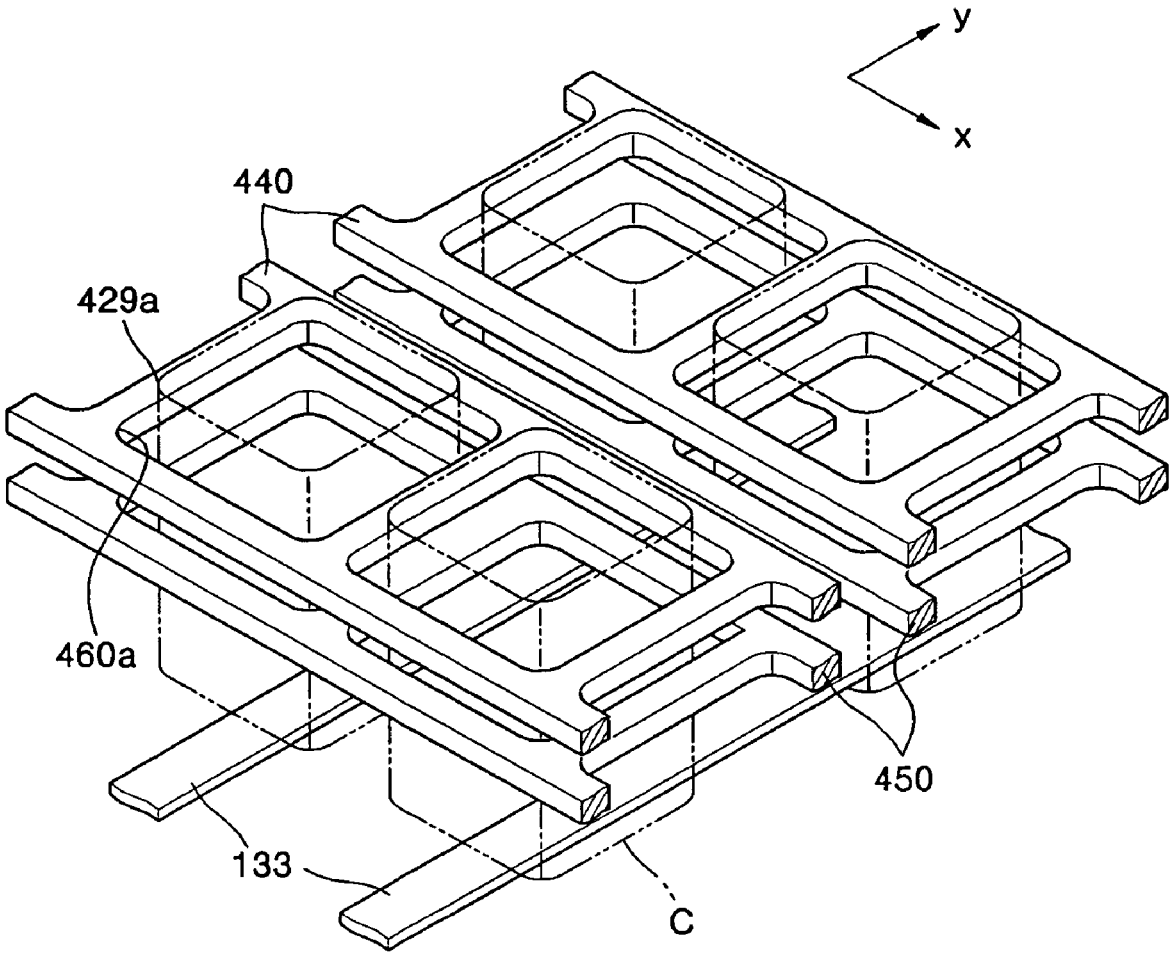
FIG. 19 is a perspective view of a modified version of FIG. 17.
Figure 20:
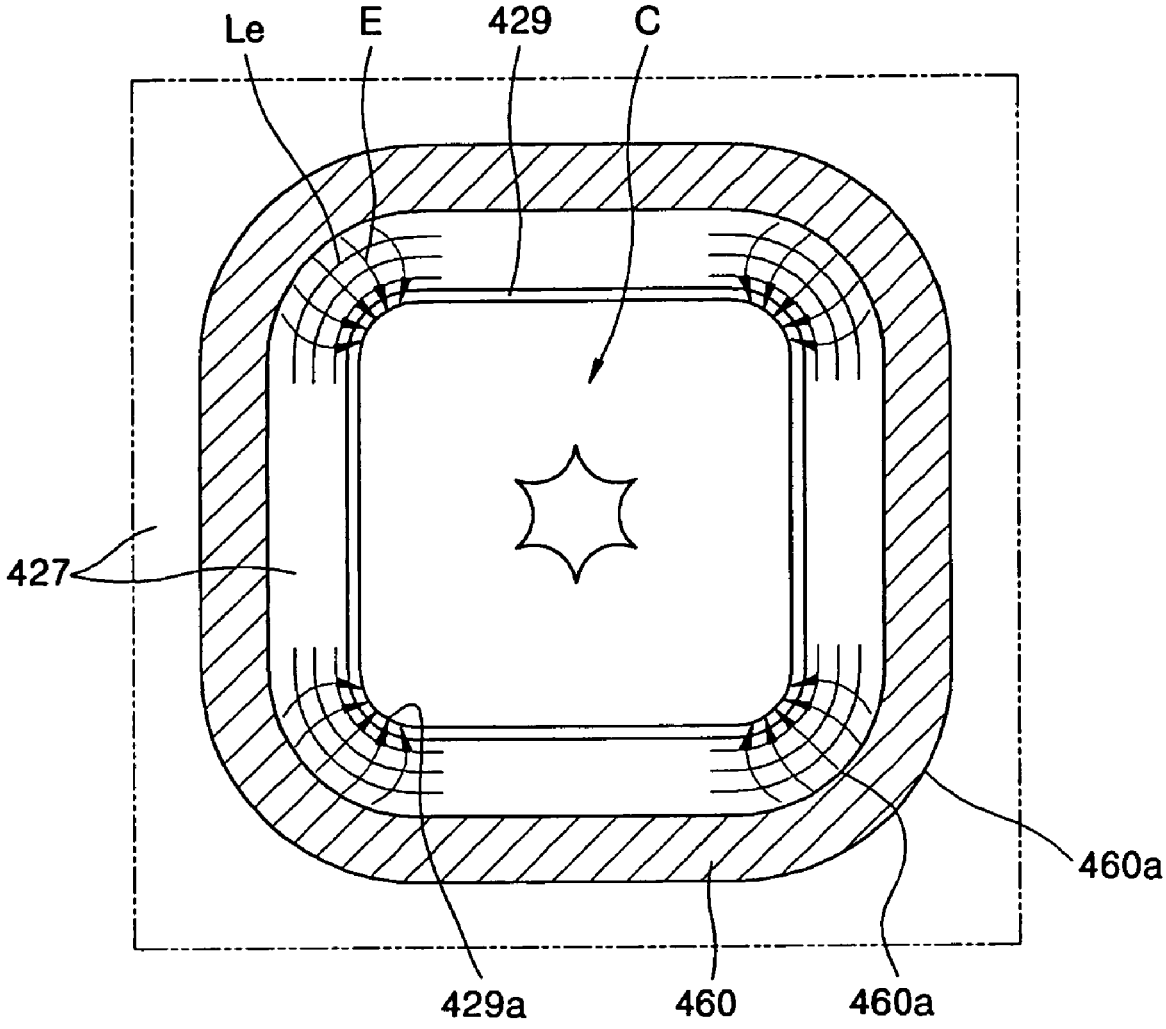
FIG. 20 is a cross-sectional view of a modified version of FIG. 18 with the electrodes located as in FIG. 19.

The corner part 460*a* of the front discharge electrodes 440 and/or the rear discharge electrodes 450 is preferably rounded, like the corner part 427*a* of the first barrier rib 427, as depicted in FIGS. 19 and 20, to reduce the formation of edge curls Ec on the electrodes, and to generate a uniform discharge. If the corner part 460*a* of the discharge electrodes 460 is rounded, the discharge can be generated uniformly by generating an electric field having the same energy level at the corner part 427*a* of the first barrier rib 427 as in the other parts of the discharge electrodes, since the contour potential surface Le generated at the corner part of the discharge cell is parallel to an inner side surface of the discharge cell. Also, as described in the PDP 100 according to the first embodiment, the formation of edge-curls Ec can be prevented or reduced by rounding the corners of a front discharge electrode 440 and a rear discharge electrode 450 at the meeting of surfaces that surround each discharge cell C.

The PDP 400 according to the third embodiment of the present invention can also be modified in the same way as the first embodiment, such that no address electrodes are formed in the PDP 300, and the barrier rib can be divided into a central barrier rib and a side barrier rib or formed in one body.

As described above, the PDP according to the present invention has the following advantages.

First, the aperture ratio of the front panel can be greatly increased, since visible light passes through only the front panel. Therefore, the transmittance of light can be increased to 90%, from the conventional transmittance of 60%.

Second, the efficiency of light emission is increased, since the vertical and horizontal sizes of the discharge cell are similar. Thus, the discharge region is uniformly distributed in the discharge cell, the electric field is concentrated in the central part of the discharge cell, and no unwanted discharge occurs. Also, a space charge can be effectively used for discharging, since the discharge diffuses into the central part of a discharge cell from the sides, and accordingly, plasma also concentrates in the central part of the discharge space, due to the electric field formed by supplying a voltage to discharge electrodes on the sides of the discharge cell.

Third, the volume of plasma can be greatly increased, since the discharge begins at the sides of the discharge space and diffuses into the central part of the discharge space.

Fourth, the efficiency of light emission of the PDP according to the present invention is greatly increased, since the PDP can be operated at a low driving voltage.

Fifth, the efficiency of light emission can be increased even if a high concentration of Xe gas is used as a discharge gas. When a high concentration of Xe gas is used to increase the efficiency of light emission, a low driving voltage is normally difficult. However, as described above, the efficiency of light emission can be increased, since the PDP according to the present invention can be operated at a low driving voltage even if Xe gas is used as the discharge gas.

Sixth, the PDP according to the present invention has a short discharge response time and can be operated at a low driving voltage. In the PDP according to the present invention, the discharge electrodes can be an electrode having a low resistance, such as a metal electrode, instead of a transparent electrode which has a high resistance, since the discharge electrodes are located on the sides of the discharge space instead of in the path of visible light. Therefore, discharge response time is short and a low driving voltage is possible without the distortion of waveforms.

Seventh, permanent latent images can be prevented. In the PDP according to the present invention, the collision of discharge ions with a phosphor can be prevented, since plasma is concentrated in the central part of the discharge space by the electric fields generated when a voltage is applied to the discharge electrodes formed on sides of the discharge space. Thus, permanent latent images caused by ion sputtering to the phosphor can be prevented. When a high concentration of Xe gas is used as the discharge gas, the problem of permanent latent images is normally serious. However, in the PDP according to the present invention, this is prevented, since the discharge occurs uniformly in the discharge space.

Eighth, the discharge driving voltage in each discharge cell can be kept virtually identical, by varying the depth of the discharge electrodes according to the dielectric constant of each discharge cell, thereby securing a wide voltage margin.

Ninth, the efficiency of the display panel can be increased by improving the discharge efficiency, by uniformly generating the discharge along the inner side surfaces of the discharge cell and concentrating the discharge in the central part of the discharge space, especially by solving the problem of non-uniform discharge at the corners of the discharge cell.

While the present invention has been particularly shown and described with reference to exemplary embodiments thereof, it will be understood by those of ordinary skill in the art that various changes in form and details can be made therein without departing from the spirit and scope of the present invention as defined by the following claims.

What is claimed is:

1. A Plasma Display Panel (PDP) comprising:

a front panel;

a rear panel parallel to and separated from the front panel;

a plurality of first barrier ribs of a dielectric, arranged between the front panel and the rear panel, and adapted to define discharge cells together with the front panel and the rear panel;

front discharge electrodes and rear discharge electrodes disposed apart to surround each discharge cell within the first barrier ribs, each of the front discharge electrodes and rear discharge electrodes including main line parts and corner parts adapted to connect the adjacent main line parts, wherein inner surfaces of the corner parts facing each discharge cell, are rounded;

a phosphor layer arranged in each discharge cell defined by the first barrier ribs; and a discharge gas filling each discharge cell.

2. The PDP of claim 1, wherein the inner surfaces of the corner parts are rounded with a radius of at least 5% of the width of a surface having a lesser width of the main line parts adjacent to the inner corner.

3. The PDP of claim 2, wherein an outer surface of at least one corner part is rounded.

4. The PDP of claim 3, wherein the outer corner of the at least one corner part is rounded with the same radius curvature of the inner surface of the corner part.

5. The PDP of claim 1 further comprising a plurality of second barrier ribs adapted to define the discharge cells together with the plurality of first barrier ribs, the plurality of second barrier ribs being arranged between the plurality of first barrier ribs and the rear panel and the phosphor layer being arranged at least on a side surface of the plurality of second barrier ribs.

6. The PDP of claim 1, wherein the front discharge electrodes and the rear discharge electrodes extend in one direction and wherein the PDP further comprises address electrodes extending to cross the front discharge electrodes and the rear discharge electrodes.

7. The PDP of claim 6, wherein the address electrodes are arranged between the rear panel and the phosphor layer, and wherein a dielectric layer is arranged between the phosphor layer and the address electrodes.

8. The PDP of claim 1, wherein the front discharge electrodes extend in one direction, and the rear discharge electrodes extend to cross the front discharge electrodes.

9. A Plasma Display Panel (PDP) comprising:

a front panel;

a rear panel parallel to and separated from the front panel;

a plurality of first barrier ribs of a dielectric, arranged between the front panel and the rear panel and adapted to define discharge cells together with the front panel and the rear panel by including a plurality of surfaces that surround sides of each discharge cell and meet at an obtuse angle;

a plurality of front discharge electrodes and rear discharge electrodes arranged within the plurality of first barrier ribs and adapted to surround each discharge cell;

a phosphor layer adapted to emit visible light in response to receiving ultraviolet rays, the phosphor layer being arranged within each discharge cell; and a discharge gas filling each discharge cell.

10. The PDP of claim 9, further comprising a protective layer having a plurality of surfaces that meet at an obtuse angle, the protective layer covering at least some of the plurality of first barrier ribs.

11. The PDP of claim 9, further comprising a second plurality of barrier ribs adapted to define the discharge cells together with the first plurality of barrier ribs, the second plurality of barrier ribs being arranged between the first plurality of barrier ribs and the rear panel, and the second plurality of barrier ribs including a plurality of surfaces adapted to surround the sides of each discharge cell and meet at an obtuse angle.

12. The PDP of claim 9, wherein the front discharge electrodes and the rear discharge electrodes include a plurality of surfaces adapted to surround the sides of each discharge cell and meet at an obtuse angle.

13. The PDP of claim 9, wherein the front discharge electrodes and the rear discharge electrodes extend in one direction, and the PDP further comprises address electrodes extending to cross the front discharge electrodes and the rear discharge electrodes.

14. The PDP of claim 13, wherein the address electrodes are arranged between the rear panel and the phosphor layer, and a dielectric layer is arranged between the phosphor layer and the address electrodes.

15. The PDP of claim 9, wherein the front discharge electrodes extend in one direction, and the rear discharge electrodes extend to cross the front discharge electrodes.

16. A Plasma Display Panel (PDP) comprising:

a front panel;

a rear panel parallel to and separated from the front panel;

a plurality of first barrier ribs of a dielectric, the plurality of first barrier ribs being arranged between a front panel and a rear panel and adapted to define discharge cells together with the front panel and the rear panel by including a plurality of surfaces adapted to surround sides of each discharge cell and meet at a rounded corner;

a plurality of front discharge electrodes and rear discharge electrodes separated from each other within the plurality of first barrier ribs and adapted to surround each discharge cell;

a phosphor layer adapted to emit visible light in response to receiving ultraviolet rays, the phosphor layer being arranged in each discharge cell; and a discharge gas filling each discharge cell.

17. The PDP of claim 16, wherein at least some of the plurality of first barrier ribs are covered by a protective layer having a plurality of surfaces that meet at an obtuse angle.

18. The PDP of claim 16 further comprising a plurality of second barrier ribs adapted to define the discharge cells together with the plurality of first barrier ribs, the plurality of second barrier ribs being arranged between the first plurality of barrier ribs and the rear panel, and the plurality of second barrier ribs including a plurality of surfaces adapted to surround sides of each discharge cell and meet at an obtuse angle.

19. The PDP of claim 16, wherein at least one of the front and rear discharge electrodes includes a plurality of inner surfaces adapted to surround each discharge cell and meet each other with rounded inner corners, the plurality of inner surfaces arranged separately in the plurality of first barrier ribs.

20. The PDP of claim 16, wherein the inner corner of the electrodes and the corner of the plurality of barrier ribs are rounded with a radius of 5-50% of the width of a surface adjacent to the inner corner of the electrodes.

21. The PDP of claim 20, wherein at least one of the front and rear discharge electrodes includes a plurality of outer surfaces that meet each other with rounded outer corners.

22. The PDP of claim 21, wherein the outer corner and the inner corners are rounded with the same radius.

23. The PDP of claim 16, wherein the front and rear discharge electrodes extend in one direction, and the PDP further comprises address electrodes extending to cross the front and rear discharge electrodes.

24. The PDP of claim 16, wherein the address electrodes are arranged between the rear panel and the phosphor layer, and a dielectric layer is arranged between the phosphor layer and the address electrodes.

25. The PDP of claim 16, wherein the front discharge electrodes extend in one direction, and the rear discharge electrodes extend to cross the front discharge electrodes.

* * * * *